US008356814B2

(12) United States Patent
Inoue

(10) Patent No.: US 8,356,814 B2
(45) Date of Patent: Jan. 22, 2013

(54) SHEET CONVEYING APPARATUS, IMAGE FORMING APPARATUS, AND IMAGE READING APPARATUS

(75) Inventor: Hiroshige Inoue, Tokyo (JP)

(73) Assignee: Canon Kabushiki Kaisha (JP)

( * ) Notice: Subject to any disclaimer, the term of this patent is extended or adjusted under 35 U.S.C. 154(b) by 110 days.

(21) Appl. No.: 12/473,261

(22) Filed: May 27, 2009

(65) Prior Publication Data

US 2009/0295075 A1 Dec. 3, 2009

(30) Foreign Application Priority Data

May 28, 2008 (JP) ..... 2008-139983

(51) Int. Cl.
*B65H 5/02* (2006.01)

(52) U.S. Cl. ..... 271/274; 271/273; 271/226; 271/228

(58) Field of Classification Search ..... 271/228, 271/272–274, 226
See application file for complete search history.

(56) References Cited

U.S. PATENT DOCUMENTS 5,078,384 A * 1/1992 Moore ..... 271/228
5,417,416 A * 5/1995 Marmin et al. ..... 271/270
5,577,719 A * 11/1996 Nicoll ..... 271/227
5,681,036 A * 10/1997 Wakahara et al. ..... 271/10.12
6,308,949 B1 * 10/2001 Ito et al. ..... 271/251
6,663,103 B2 * 12/2003 Dobberstein et al. ..... 271/227
6,817,609 B2 * 11/2004 Halvonik et al. ..... 271/228
7,422,209 B2 * 9/2008 Hashimoto ..... 271/228
7,445,207 B2 * 11/2008 Obuchi et al. ..... 271/228
7,537,210 B2 * 5/2009 Kawaguchi ..... 271/226
7,686,300 B2 * 3/2010 Watanabe et al. ..... 271/251
8,041,272 B2 * 10/2011 Nedelin ..... 399/297
2007/0296141 A1 * 12/2007 Inoue ..... 271/226
2008/0006992 A1 * 1/2008 Inoue ..... 271/228
2009/0311022 A1 * 12/2009 Jacobsen et al. ..... 399/406

* cited by examiner

*Primary Examiner* — Michael McCullough
*Assistant Examiner* — Howard Sanders
(74) *Attorney, Agent, or Firm* — Rossi, Kimms & McDowell LLP

(57) ABSTRACT

An aspect of the invention provides a sheet conveying apparatus, an image forming apparatus, and an image reading apparatus, in which generation of skew feeding caused by the shock in pressure contact of a rotation body can be reduced. An interlocking mechanism brings a driven roller 222 biased by a biasing member into pressure contact with a feeding portion 221*c* of a driving roller 221 in conjunction with rotation of the driving roller 221. The driving roller 221 includes a non-feeding portion 221*d* in a circumferential surface thereof. The driven roller 222 is caused to abut on a pressure holder 225 before the driven roller 222 moved in a direction in which the interlocking mechanism brings the driven roller 222 into the pressure contact with the driving roller 221 is brought into the pressure contact with the driving roller 221.

17 Claims, 20 Drawing Sheets

SHEET CONVEYING APPARATUS, IMAGE FORMING APPARATUS, AND IMAGE READING APPARATUS

BACKGROUND OF THE INVENTION

1. Field of the Invention

The present invention relates to a sheet conveying apparatus, an image forming apparatus, and an image reading apparatus, particularly to a configuration for correcting skew feeding and crosswise misalignment of a sheet, such as recording paper and an original, which is conveyed to an image forming portion or an image reading portion.

2. Description of Related Art

Conventionally, the image forming apparatus and image reading apparatus such as a copying machine, a printer, and a facsimile include a sheet conveying apparatus that conveys the sheet such as the recording paper and original to the image forming portion and image reading portion. Sometimes the sheet conveying apparatus includes a skew feeding correction portion that corrects the skew feeding of the sheet and a displacement of the sheet in a direction orthogonal to a sheet conveying direction (hereinafter, referred to as crosswise direction) in order that an attitude and a position of the sheet are fitted until the sheet is conveyed to the image forming portion or image reading portion.

Recently, various sheets such as coated paper, emboss paper, extra thick paper, and extra thin paper are used in the image forming apparatus and the image reading apparatus. Therefore, in the image forming apparatus and the image reading apparatus, in addition to high productivity, a demand for speed enhancement and high accuracy of a skew feeding correction portion arises in order to deal with various sheets used.

In order to achieve the speed enhancement and high accuracy of the skew feeding correction portion, for example, U.S. Pat. No. 6,663,103 discloses an active skew feeding correction type skew feeding correction portion that corrects the skew feeding while the sheet is conveyed without tentatively stopping the sheet.

FIG. 17 illustrates a configuration of a conventional skew feeding correction portion. Referring to FIG. 17, a pair of skew feeding correction rollers 25*a* corrects skew feeding of a sheet S, and a pair of registration rollers 25*b* corrects a crosswise displacement of the sheet S (hereinafter, referred to as crosswise registration). As illustrated in FIG. 18, the pair of skew feeding correction rollers 25*a* and the pair of registration rollers 25*b* include conveying rollers 25*a*1 and 25*b*1 and driven rollers 25*a*2 and 25*b*2, respectively. The conveying rollers 25*a*1 and 25*b*1 include outer circumferential surfaces, and the driven rollers 25*a*2 and 25*b*2 are brought into pressure contact with the conveying rollers 25*a*1 and 25*b*1.

In cases where the skew feeding of the sheet S is corrected in the skew feeding correction portion, when a sensor 26 detects the skew feeding of the sheet S, rotation speeds of driving motors M1 and M2 that drive the pair of skew feeding correction rollers 25*a* is controlled to drive the pair of skew feeding correction rollers 25*a* at a speed according to a skew feeding amount of the sheet S. Therefore, the skew feeding of the sheet S is corrected.

Then the sheet S in which the skew feeding is corrected is conveyed to the pair of registration rollers 25*b*. The pair of registration rollers 25*b* is coupled to a coupling shaft 31 that is drive by a driving motor M3. A crosswise registration sensor 30 is disposed on a downstream side of the pair of registration rollers 25*b* in order to detect the crosswise registration. When the crosswise registration sensor 30 detects the crosswise registration, the driving motor M4 moves the coupling shaft 31 in the crosswise direction according to a crosswise registration amount of the sheet S. Therefore, the pair of registration rollers 25*b* is moved in the crosswise direction, and the crosswise registration of the sheet S is corrected.

When the pair of registration rollers 25*b* corrects the crosswise registration, the pair of skew feeding correction rollers 25*a* is avoided from becoming a resistance. Specifically, in correcting the crosswise registration, as illustrated in FIG. 18B, a conveying roller 25*a*1 of the pair of skew feeding correction rollers 25*a* that is rotated in a direction of an arrow is controlled such that an outer circumferential surface 33 is located at a cut-out position.

After the crosswise registration is corrected, the sheet S is conveyed to the conveying belt 10, and the conveying belt 10 conveys the sheet S onto the downstream side. The conveying belt 10 avoids the pair of registration rollers 25*b* from becoming the resistance against the sheet S. Specifically, in conveying the sheet S, as illustrated in FIG. 18B, a conveying roller 25*b*1 of the pair of registration rollers 25*b* is controlled such that the outer circumferential surface 33 is located at the cut-out position.

When the conveying rollers 25*a*1 and 25*b*1 are located at the cut-out position, the driven rollers 25*a*2 and 25*b*2 that are brought into pressure contact with the conveying rollers 25*a*1 and 25*b*1 drop in a pressurizing direction, and the driven rollers 25*a*2 and 25*b*2 are projected into a conveying guide path. When the driven rollers 25*a*2 and 25*b*2 are projected into the conveying guide path, the driven rollers 25*a*2 and 25*b*2 become a conveying resistance against the sheet S.

Conventionally, a mechanical link mechanism (not illustrated) moves the driven rollers 25*a*2 and 25*b*2 in a direction in which the driven rollers 25*a*2 and 25*b*2 are separated from the conveying rollers 25*a*1 and 25*b*1 at the positions where the outer circumferential surfaces 33 of the conveying rollers 25*a*1 and 25*b*1 are cut out. That is, the mechanical link mechanism separates the driven rollers 25*a*2 and 25*b*2 in synchronization with phases of the conveying rollers 25*a*1 and 25*b*1. This enables the sheet skew feeding and the crosswise registration to be continuously corrected.

However, in the conventional sheet conveying apparatus, image forming apparatus, and image reading apparatus, after the driven roller is separated in synchronization with the phase of the conveying roller, the driven roller is brought into pressure contact with the conveying roller in predetermined timing by a biasing force of biasing means (not illustrated). When the driven roller is brought into pressure contact with the conveying roller, a shock is applied to the driven roller, and vibration is generated in the driven roller as illustrated in FIG. 19.

The vibrations are not always generated at the same time in the driven rollers provided in the crosswise direction. Sometimes the driven rollers 25*b*2 of the pair of registration rollers 25*b* are vibrated in a back and forth direction with respect to the sheet conveying direction as illustrated in FIG. 20A, and sometimes the driven rollers 25*b*2 are vibrated in the opposite direction to the pressurizing direction as illustrated in FIG. 20B.

When the sheet is conveyed to a nip of the pair of registration rollers 25*b* before the vibration of the driven roller is attenuated, a displacement is generated in the sheet conveying direction by the pair of registration rollers 25*b*, and a nip pressure of the pair of registration rollers 25*b* becomes unstable. In such cases, random skew feeding is generated each time the sheet in which the skew feeding is corrected is nipped between the pair of registration rollers 25*b*. Particularly, in the case of thin sheet such as 37-g to 52-g paper, the sheet is easily influenced by the nip pressure of the pair of registration rollers 25*b*, the random skew feeding (variation in skew feeding) is remarkably generated.

In order to reduce the shock in bringing the driven roller into pressure contact with the conveying roller, it is necessary that component accuracy of the mechanical link mechanism be improved to finely adjust a separation amount and attachment/detachment timing of the driven roller as much as possible. However, the mechanical link mechanism becomes complicated and a huge amount of time is required for the adjustment, which results in large cost increase.

Because an elastic roller (rubber roller) is used on at least one of the driving side and the driven side of the pair of registration rollers 25*b*, duration abrasion is generated, and the separation amount is easily changed according to the duration abrasion. Therefore, it is necessary to frequently exchange the rollers, and a work load on a service person is increased because the adjusting work is generated in each roller exchange in the field.

The present invention has been made in view of these circumstances, and an object thereof is to provide a sheet conveying apparatus, an image forming apparatus, and an image reading apparatus, in which the generation of the skew feeding caused by the shock in the pressure contact of the pair of rotation bodies can be reduced.

SUMMARY OF THE INVENTION

In accordance with an aspect of the invention, a sheet conveying apparatus that conveys a sheet includes a driving rotation body that has a notch in a circumferential surface thereof; a driven rotation body that can pressure-contact the circumferential surface of the driving rotation body; a holding portion that rotatably holds the driven rotation body; a biasing member that biases the holding portion in a direction in which the driven rotation body is brought into pressure contact with the driving rotation body; an interlocking mechanism that moves the driven rotation body between a pressure contact position and a separation position in conjunction with rotation of the driving rotation body, the driven rotation body being brought into pressure contact with the driving rotation body at the pressure contact position, the driven rotation body being separated from the driving rotation body at the separation position; and an abutment portion that abuts the driven rotation body to stop the driven rotation body at the pressure contact position, the driven rotation body being moved in a direction in which the driven rotation body is brought into pressure contact with the driving rotation body by the interlocking mechanism, wherein the holding portion or the driven rotation body is caused to abut on the abutment portion before the interlocking mechanism brings the driven rotation body into pressure contact with a circumferential surface of the driving rotation body.

Accordingly, before the driven rotation body is brought into the pressure contact with the driving rotation body, the holding portion or the driven rotation body is caused to abut on the abutment portion to reduce the shock caused in the pressure contact of the driven rotation body with the driving rotation body, so that the generation of the skew feeding caused by the shock in the pressure contact of the rotation body can be reduced.

Further features of the present invention will become apparent from the following description of exemplary embodiments (with reference to the attached drawings).

DESCRIPTION OF THE EMBODIMENTS

An exemplary embodiment of the invention will be described in detail with reference to the drawings.

Figure 1:
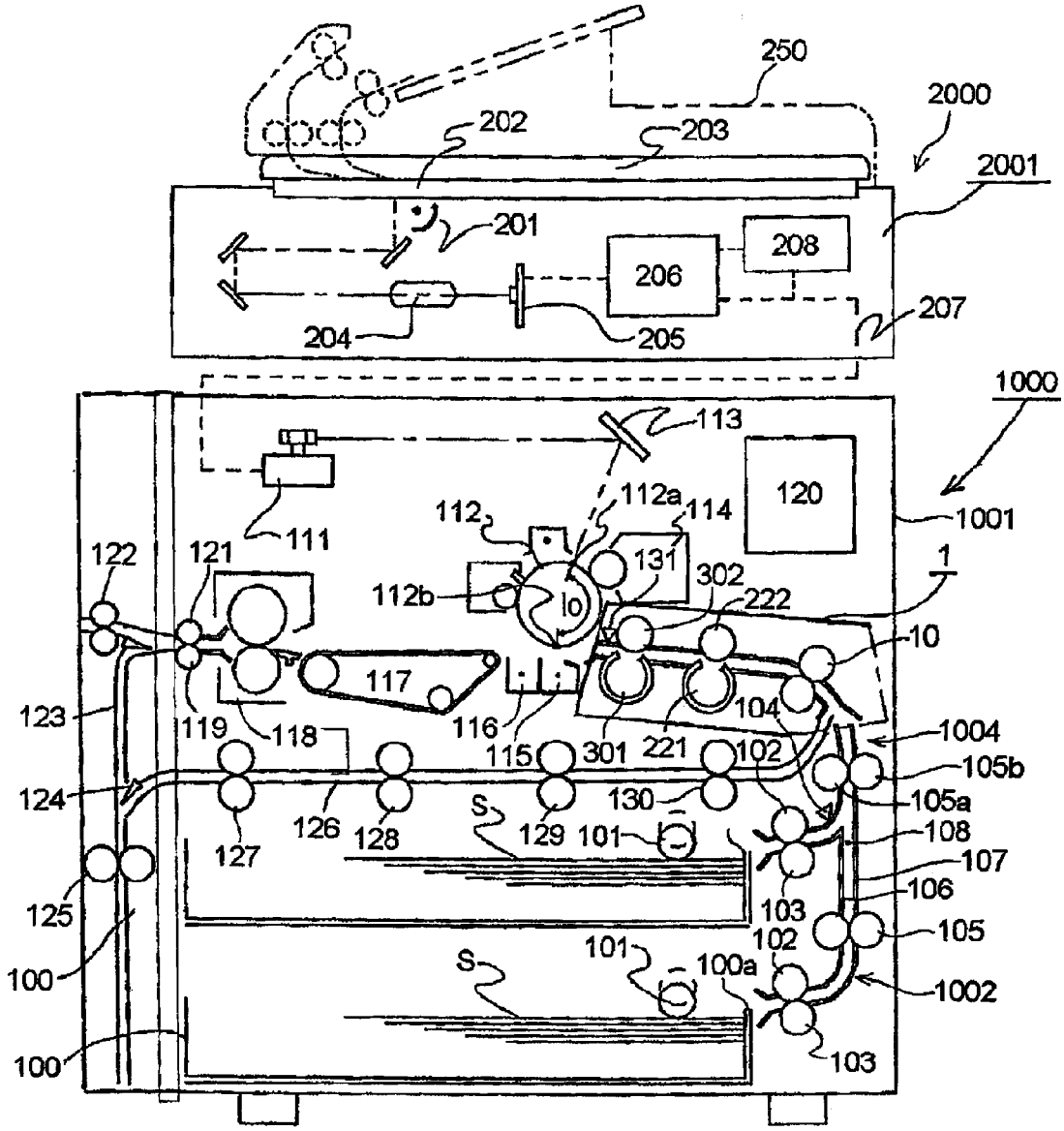
FIG. 1 schematically illustrates a printer that is of an example of an image forming apparatus including a sheet conveying apparatus according to an embodiment of the invention.

FIG. 1 schematically illustrates a printer that is of an example of an image forming apparatus including a sheet conveying apparatus according to an embodiment of the invention.

Referring to FIG. 1, a printer 1000 includes a printer main body 1001 and a scanner 2000 provided on the top of the printer main body 1001.

The scanner 2000 that reads the original includes a scanning optical system light source 201, a platen glass 202, and an original platen 203 that is opened and closed. The scanner 2000 also includes an image reading portion 2001. The image reading portion 2001 includes a lens 204, a light-receiving element (photoelectric conversion element) 205, an image processing portion 206, and a memory portion 208. An image processing signal processed by the image processing portion 206 is stored in the memory portion 208.

In reading the original, the original (not illustrated) placed on the platen glass 202 is read by irradiating the original with light emitted from the scanning optical system light source 201. After the read original image processed by the image processing portion 206, the original image is converted into an electrically-coded electric signal 207, and the electric signal 207 is transmitted to a laser scanner 111 that is of image forming means. Alternatively, the image information processed and coded by the image processing portion 206 is tentatively stored in the memory portion 208, and the image information may be transmitted to the laser scanner 111 in response to a signal from a controller 120 as needed.

The printer main body 1001 includes a sheet feeding device 1002, a sheet conveying apparatus 1004, and the controller 120. The sheet conveying apparatus 1004 conveys a sheet S fed from the sheet feeding device 1002 to an image forming portion 1003. The controller 120 that is of control means for controlling the printer 1000.

The sheet feeding device 1002 includes a cassette 100, a pickup roller 101, and a separating portion. The separating portion includes a feed roller 102 and a retard roller 103. The pickup roller 101 is lifted and lowered at predetermined timing. The sheets S in the cassette 100 are separated and fed one by one by the action of the pickup roller 101 and the separating portion.

The sheet conveying apparatus 1004 includes a pair of longitudinal path rollers 105 (105*a* and 105*b*), a pair of assist rollers 10, and a registration portion 1. The registration portion 1 includes a skew feeding correction portion and a registration correction portion.

The pair of longitudinal path rollers 105 passes the sheet S fed from the sheet feeding device 1002 through a sheet conveying passage 108 including guide plates 106 and 107 whose upper portion is curved, and the sheet S is guided to the registration portion 1. Then, the skew feeding and crosswise displacement of the sheet S are corrected in the registration portion 1, and the sheet S is conveyed to the image forming portion 1003.

The image forming portion 1003 is an electrophotographic system. The image forming portion 1003 includes a photosensitive drum 112 that is of an image bearing member, a laser scanner 111 that is of an image writing means, a development device 114, a transfer charger 115, and a separating charger 116.

In forming an image, a laser beam from the laser scanner 111 is folded by a mirror 113, an exposure position 112*a* on the photosensitive drum 112 rotated clockwise is irradiated with the laser beam, and a latent image is formed on the photosensitive drum 112. Then the latent image formed on the photosensitive drum 112 is visualized in the form of toner image by the development device 114.

The toner image visualized on the photosensitive drum is transferred to the sheet S by the transfer charger 115*a* in a transfer portion 112*b*. 10 is a distance from the laser beam irradiation position 112*a* to the transfer portion 112*b* of the photosensitive drum 112.

The separating charger 116 separates the sheet S to which the toner image is transferred from the photosensitive drum 112 in an electrostatic manner, and a conveying belt 117 conveys the sheet S to a fixing device 118. The fixing device 118 fixes the toner image to the sheet S, and a discharge roller 119 discharges the sheet S.

In FIG. 1, a registration sensor 131 is provided on a downstream side of a registration correction portion, and the registration sensor 131 detects the sheet S passed through the registration correction portion. When the registration sensor 131 detects the sheet S passed through the registration correction portion, the controller 120 transmits a sheet leading end signal (image reading start signal) to the laser scanner 111, for example, in T seconds based on the detection signal, as described below. Therefore, the laser scanner 111 starts the laser beam irradiation.

In the embodiment, the printer main body 1001 and the scanner 2000 are separated from each other. Alternatively, the printer main body 1001 and the scanner 2000 may integrally be formed. Even if the printer main body 1001 is separated from or integral with the scanner 2000, the printer main body 1001 acts as a copying machine when a processing signal of the scanner 2000 is fed into the laser scanner 111, the printer main body 1001 acts as FAX when a transmission signal of FAX is fed, and the printer main body 1001 acts as a printer when an output signal of a personal computer is fed.

On the contrary, the printer main body 1001 acts as FAX when the processing signal of the image processing portion 206 of the scanner 2000 of the image processing portion 206 is transmitted to another FAX. When an automatic original feeding apparatus 250 illustrated by an alternate long and two short dashes line is mounted on the scanner 2000 instead of the original platen 203, the scanner 2000 can automatically read the original. In cases where the images are formed in both sides of the sheet, the sheet in which the image is formed in one side is conveyed again to the image forming portion 1003 through an inversion path 123 and a both-sided path 126.

The registration portion 1 will be described below.

Figure 2:
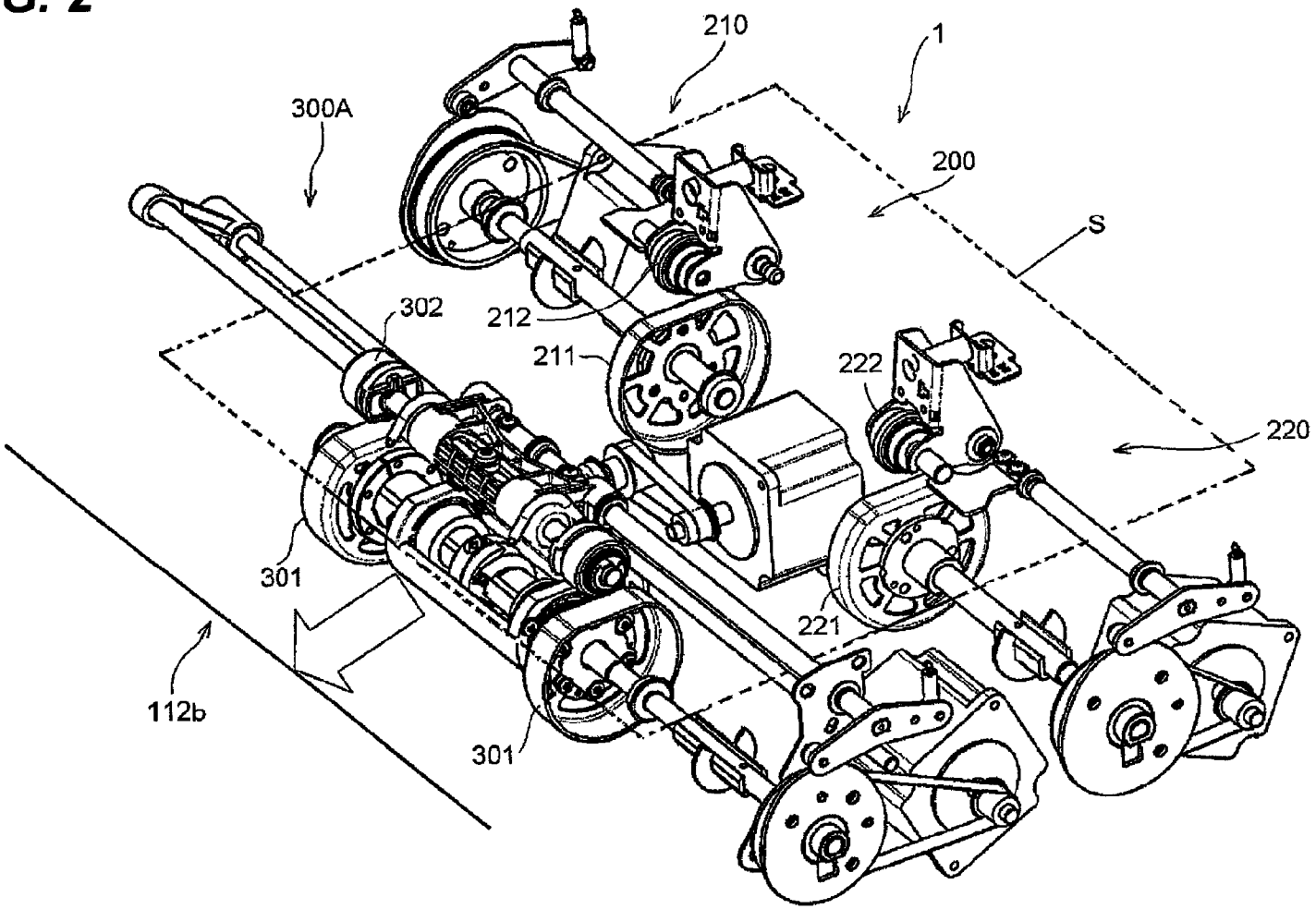
FIG. 2 illustrates a configuration of a registration portion provided in the sheet conveying apparatus.
Figure 3:
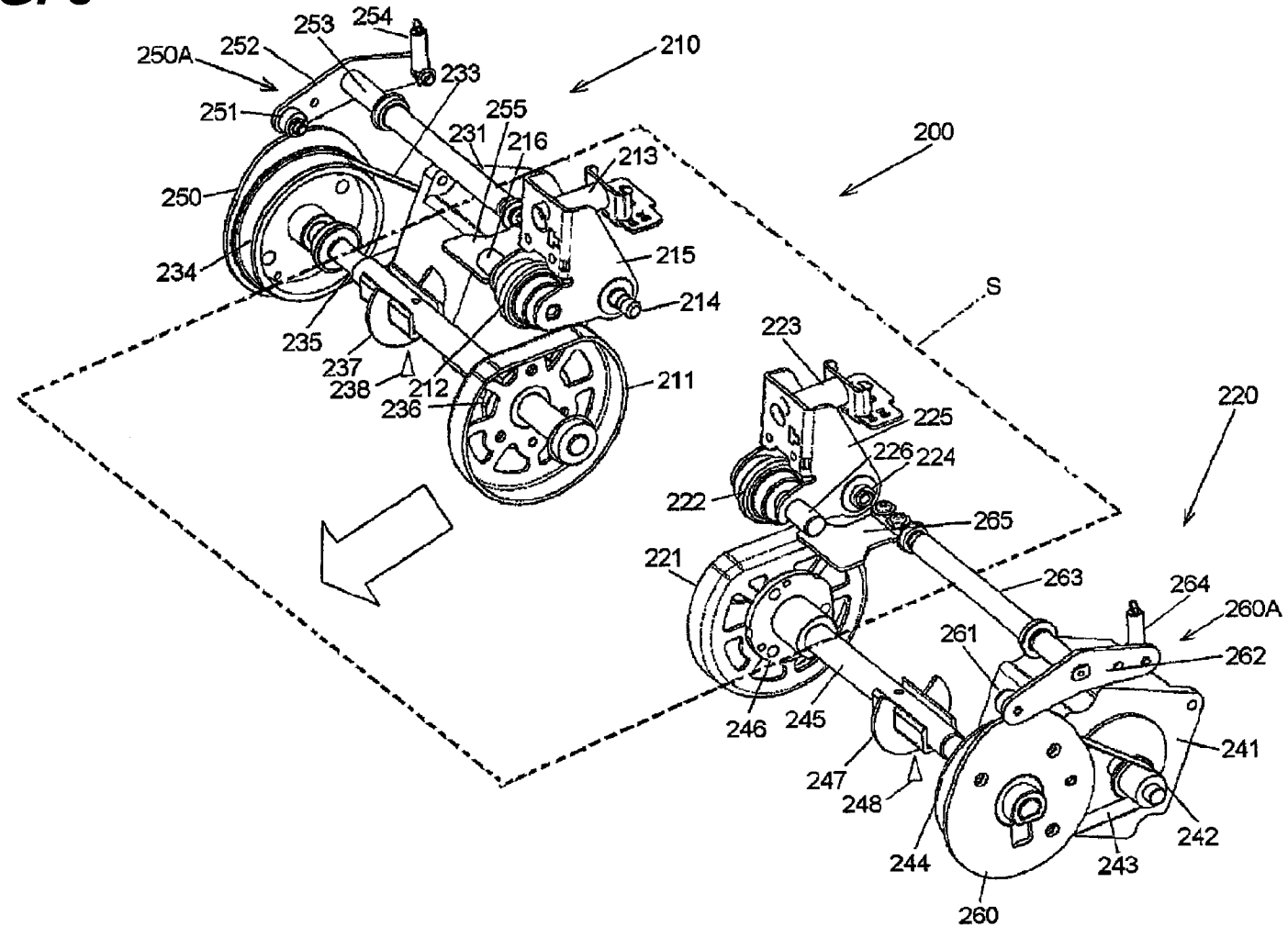
FIG. 3 is a first perspective view illustrating a configuration of a skew feeding correction portion provided in the registration portion.

FIG. 2 illustrates a configuration of a registration portion 1. The registration portion 1 includes a skew feeding correction portion 200 and a registration correction portion 300A. The skew feeding correction portion 200 that is of a skew feeding correction mechanism corrects the skew feeding of the sheet. The registration correction portion 300A that is of a crosswise displacement correction mechanism corrects the crosswise displacement of the sheet. As illustrated in FIG. 3, the skew feeding correction portion 200 includes a pair of skew feeding correction rollers 210 and 220 that is provided with a predetermined interval in a crosswise direction.

The skew feeding correction rollers 210 and 220 include driving rollers 211 and 221 and driven rollers 212 and 222, respectively. The driving rollers 211 and 221 are driving rotation bodies having notches in circumferential surfaces thereof. The driven rollers 212 and 222 are driven rotation bodies that can be brought into contact with and separated from the driving rollers 211 and 221. The driven rollers 212 and 222 are pressurized by pressure springs 213 and 223 that are of biasing members, and the driven rollers 212 and 222 are rotatably supported at swing ends of pressure holders 215 and 225 that are swung about driven roller pressure shafts 214 and 224 through driven roller shafts 216 and 226.

Skew feeding correction motors 231 and 241 are coupled to the driving rollers 211 and 221 through a motor pulley 242, driving belts 233 and 243, driving pulleys 234 and 244, skew feeding correction driving shafts 235 and 245, and roller holders 236 and 246. Skew feeding correction HP sensor flags 237 and 247 are provided in skew feeding correction driving shaft 235 and 245 in order to detect roller phases, respectively. The skew feeding correction HP sensors 238 and 248 detect positions of the skew feeding correction HP sensor flags 237 and 247, thereby detecting phases (HP) of the driving rollers 211 and 221.

Skew feeding correction separation cams 250 and 260 that are of cam portions are attached to driving pulleys 234 and 244 provided in skew feeding correction driving shafts 235 and 245 that are of rotation shafts of the driving rollers 211 and 221, respectively. A link mechanism (interlocking mechanism) includes the skew feeding correction separation cams 250 and 260 and separation units 250A and 260A. In synchronization with the rotations of the driving rollers 211 and 221, the link mechanism can bring the driven rollers 212 and 222 into contact with the driving rollers 211 and 221 and separate the driven rollers 212 and 222 from the driving rollers 211 and 221.

That is, in the embodiment, the link mechanism moves the driven rollers 212 and 222 to one of a pressure contact position and a separation position in conjunction with the rotations of the driving rollers 211 and 221. The driven rollers 212 and 222 are brought into pressure contact with the driving rollers 211 and 221 at the pressure contact portion. The driven rollers 212 and 222 are separated from the driving rollers 211 and 221 at the separation position. The separation units 250A and 260A are of turning link portions brought into contact with the skew feeding correction separation cams 250 and 260, and the separation units 250A and 260A include striking rollers 251 and 261, arms 252 and 262, link shafts 253 and 263, pressure springs 254 and 264, and separation arms 255 and 265.

Figure 4:
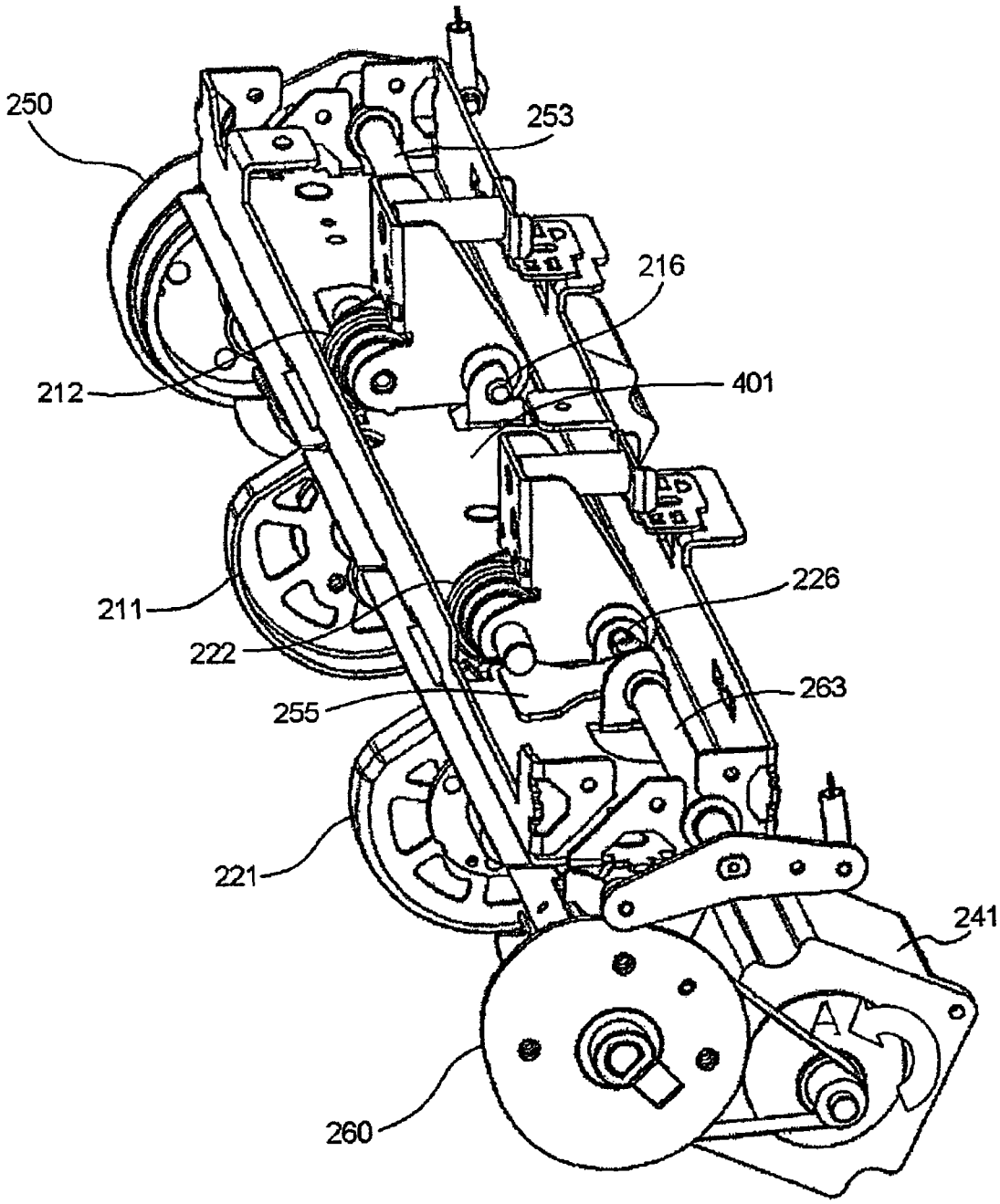
FIG. 4 is a second perspective view illustrating the configuration of the skew feeding correction portion.

As illustrated in FIG. 4, the link shafts 253 and 263 and the driven roller shafts 216 and 226 are held on a skew feeding correction frame 401. Therefore, when the driving rollers 211 and 221 are rotated, the skew feeding correction separation cams 250 and 260 and the separation units 250A and 260A are linked with high accuracy, and the contact and separation of the driven rollers 212 and 222 can accurately be controlled.

FIG. 3 illustrates the state in which notches in circumferential surfaces of the driving rollers 211 and 221 face the driven rollers 212 and 222. At this point, the roller nip portions between the driving rollers 211 and 221 and the driven rollers 212 and 222 are released, and the nip of the sheet is released.

Figure 5:
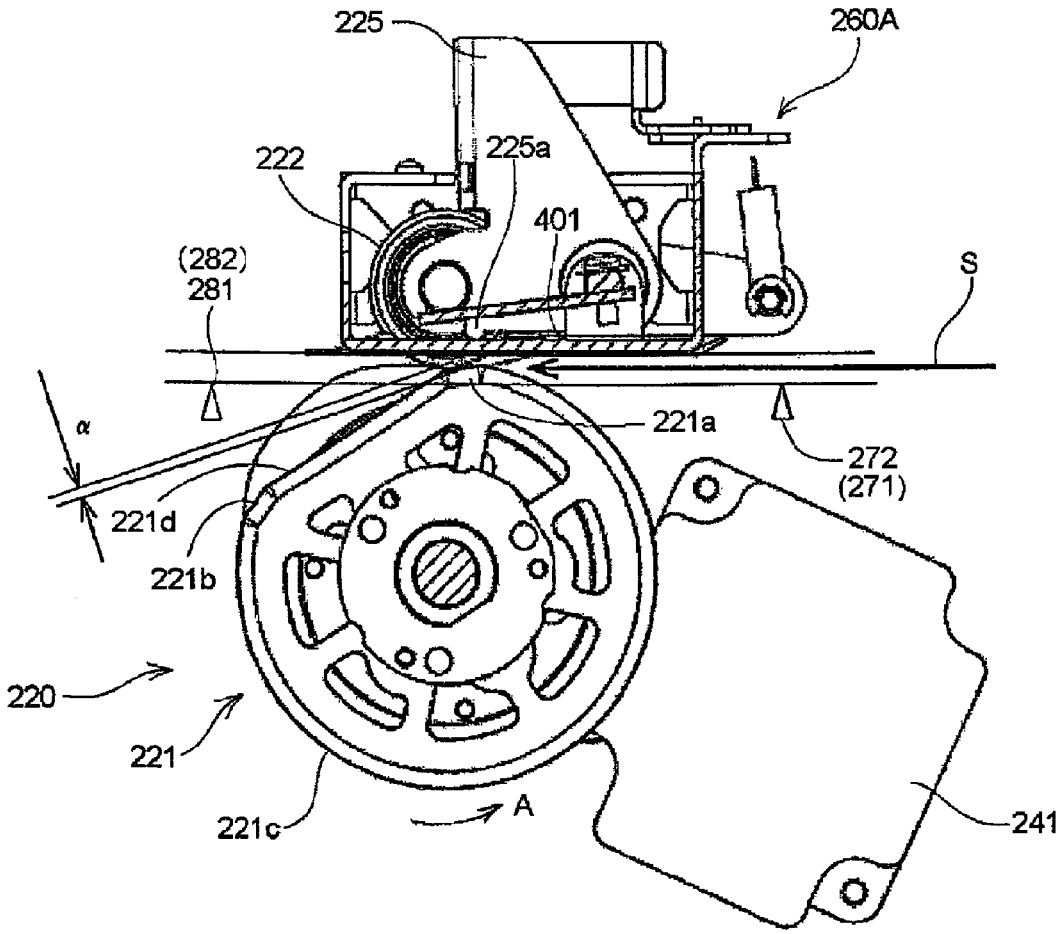
FIG. 5 is a side view illustrating the configuration of the skew feeding correction portion.

As illustrated in FIG. 5, start-up sensors 271 and 272 are provided with a predetermined interval in a crosswise direction on an upstream side in the sheet conveying direction of the pair of skew feeding correction rollers 210 and 220. When the start-up sensors 271 and 272 detect the sheet leading end, the skew feeding correction motor 241 on one side of the pair of skew feeding correction rollers 220 starts the rotation in a direction of an arrow A of FIG. 4.

The start-up sensors 271 and 272 detect a skew feeding amount of the sheet, and the skew feeding correction motor 241 starts the drive (is started up) at the time the start-up sensors 271 and 272 detect the sheet leading end. The skew feeding correction motor 241 is driven according to the timing in which the start-up sensors 271 and 272 detect the sheet leading end, which allows the sheet skew feeding to be corrected.

At this point, when the skew feeding correction motor 241 is driven, the driving roller 221 is rotated, and the driven roller 222 is synchronized with the driving roller 221 through the separation unit 260A, the driven roller 222 is moved in a downward direction in which the driven roller 222 is brought into pressure contact with the driving roller 221, and the driven roller 222 is brought into pressure contact with the driving roller 221. The driven roller 222 is brought into pressure contact with the driving roller 221. Then, the sheet S is delivered from the upstream side after a predetermined time, and the pair of skew feeding correction rollers 220 conveys the sheet S to a pair of registration rollers 300. The operation and the following operations of one of the pair of skew feeding correction rollers 220 are similar to those of the other of the pair of skew feeding correction rollers 210.

In the embodiment, as illustrated in FIG. 5, a striking portion 225*a* is provided in a bottom surface of the pressure holder 225. The pressure holder 225 is a holding portion that holds the driven roller 222. When the driven roller 222 is moved down to the pressure contact position, the striking portion 225*a* of the pressure holder 225 strikes (abuts) on an upper surface of skew feeding correction frame 401 constituting an abutment portion.

The striking portion 225*a* of the pressure holder 225 strikes on the skew feeding correction frame 401 immediately before the driving roller 221 and the driven roller 222 are brought into pressure contact with each other. Therefore, when the striking portion 225*a* strikes on the skew feeding correction frame 401, a minute gap $\alpha$ is formed between the driven roller 222 and a slope portion 221*a* of the driving roller 221.

That is, in the embodiment, in downwardly moving the driven roller 222, the driven roller 222 is not directly brought into pressure contact with (collides on) the driving roller 221, but the driven roller 222 collides on the skew feeding correction frame 401 while the pressure holder 225 is interposed therebetween before the driven roller 222 is brought into pressure contact with the driving roller 221. Then, the slope portion 221*a* of the rotating driving roller 221 is brought into pressure contact with the driven roller 222 that is in the stopped state, thereby forming the roller nip portion. The slope portion 221*a* constitutes a taper portion that couples a non-feeding portion 221*d* and a feeding portion 221*c*. The non-feeding portion 221*d* is the notch provided in the circumferential surface so as not to contact the sheet. The arc-shape feeding portion 221*c* contacts the sheet except for the non-feeding portion 221*d* of the driving roller 221.

Figure 6:
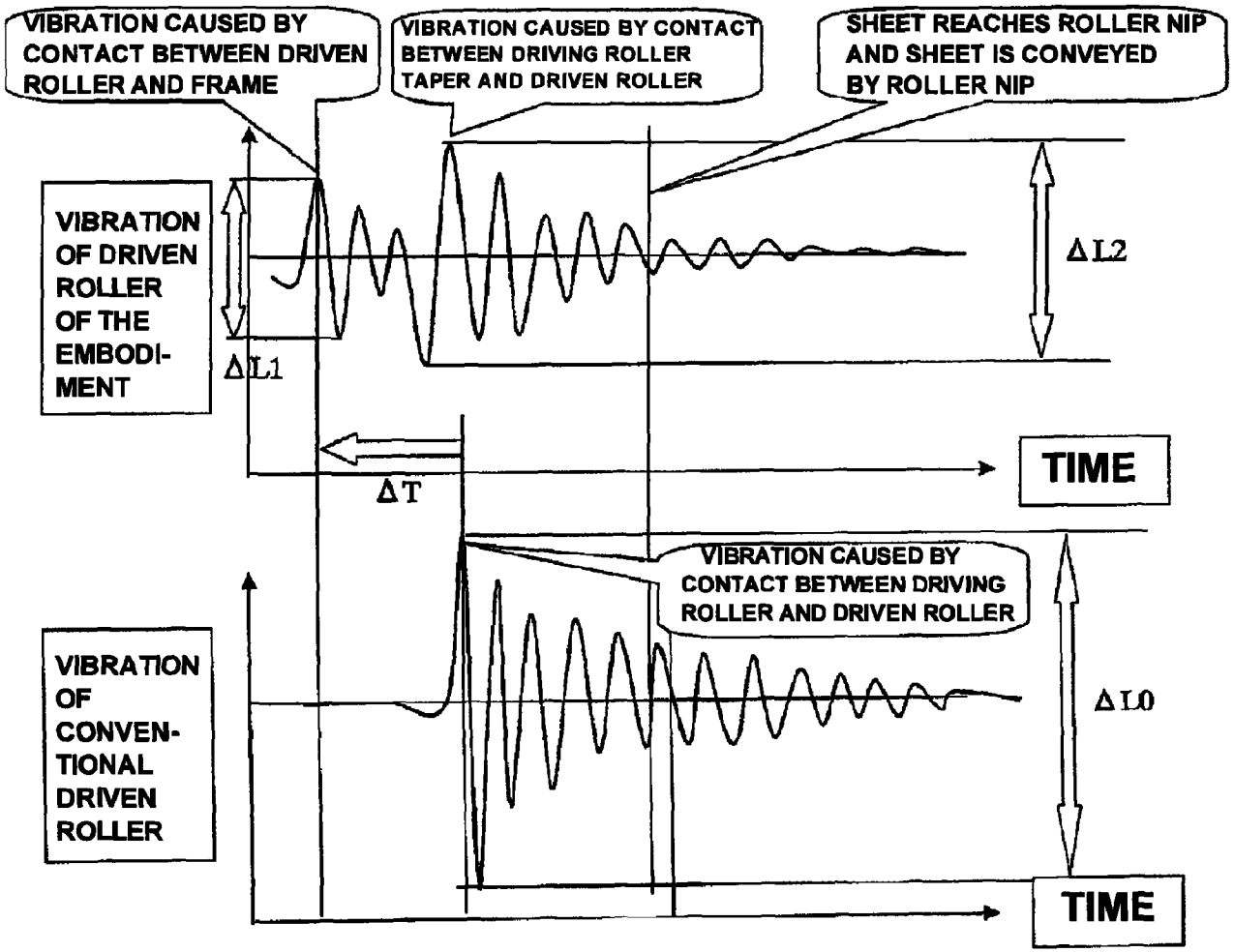
FIG. 6 illustrates a vibration of a driven roller constituting a pair of skew feeding correction rollers provided in the skew feeding correction portion.

When the driving roller 221 pressure-contacts (collides) on the driven roller 222 that is in the stopped state, vibration is generated in the driven roller 222. However, as illustrated in FIG. 6, the vibration is generated by the collision of the pressure holder 225 and the skew feeding correction frame 401 before the driven roller 222 strikes on the driving roller 221.

At this point, the vibration is generated earlier than that of the conventional technique by $\Delta T$ by the collision of the pressure holder 225 and the skew feeding correction frame 401. Further, the conveying rollers are not brought into contact with each other, so that magnitude of the shock can be reduced from $\Delta L0$ to $\Delta L1$ by adjusting an angle of the collision of the pressure holder 225 and the skew feeding correction frame 401.

When attenuation of the first vibration is started, (the taper portion of the slope portion 221*a* of) the driving roller 221 and the skew feeding driven roller 222 are brought into pressure contact with each other, thereby generating a second vibration in the skew feeding driven roller 222. However, the second vibration is smaller than that of the conventional technique, and the second vibration can be reduced by the pressure contact of the feeding portion 221*c* after the pressure contact of the slope portion 221*a*. As a result, the vibration is sufficiently attenuated until the sheet S is nipped between the pair of skew feeding correction rollers 220.

In the embodiment, before the driving roller 221 is brought into pressure contact with the driven roller 222, the striking portion 225*a* of the pressure holder 225 strikes on the skew feeding correction frame 401 to disperse the shock, thereby shortening the attenuation time of the vibration. Therefore, the shock can be reduced when the driving roller 221 is brought into pressure contact with the skew feeding driven roller 222, the vibration time can be shortened, and the influence of the vibration of the driven roller 222 can be reduced.

On the other hand, in the sheet S in which the skew feeding is corrected by the pair of skew feeding correction rollers 220 whose vibration is sufficiently attenuated, skew feeding detection sensors 281 and 282 detect the skew feeding again. As illustrated in FIG. 5, the skew feeding detection sensors 281 and 282 are disposed on the downstream side of the pair of skew feeding correction rollers 200 while separated from each other with a predetermined interval. The pair of skew feeding correction rollers 210 and 220 performs the fine skew feeding correction according to detection timing of the skew feeding detection sensors 281 and 282, and the sheet S is conveyed to the registration correction portion 300A. At this point, the sheet S is conveyed in the state in which the vibration of the driven roller 222 is sufficiently attenuated, so that the skew feeding correction can accurately be performed.

Figure 7:
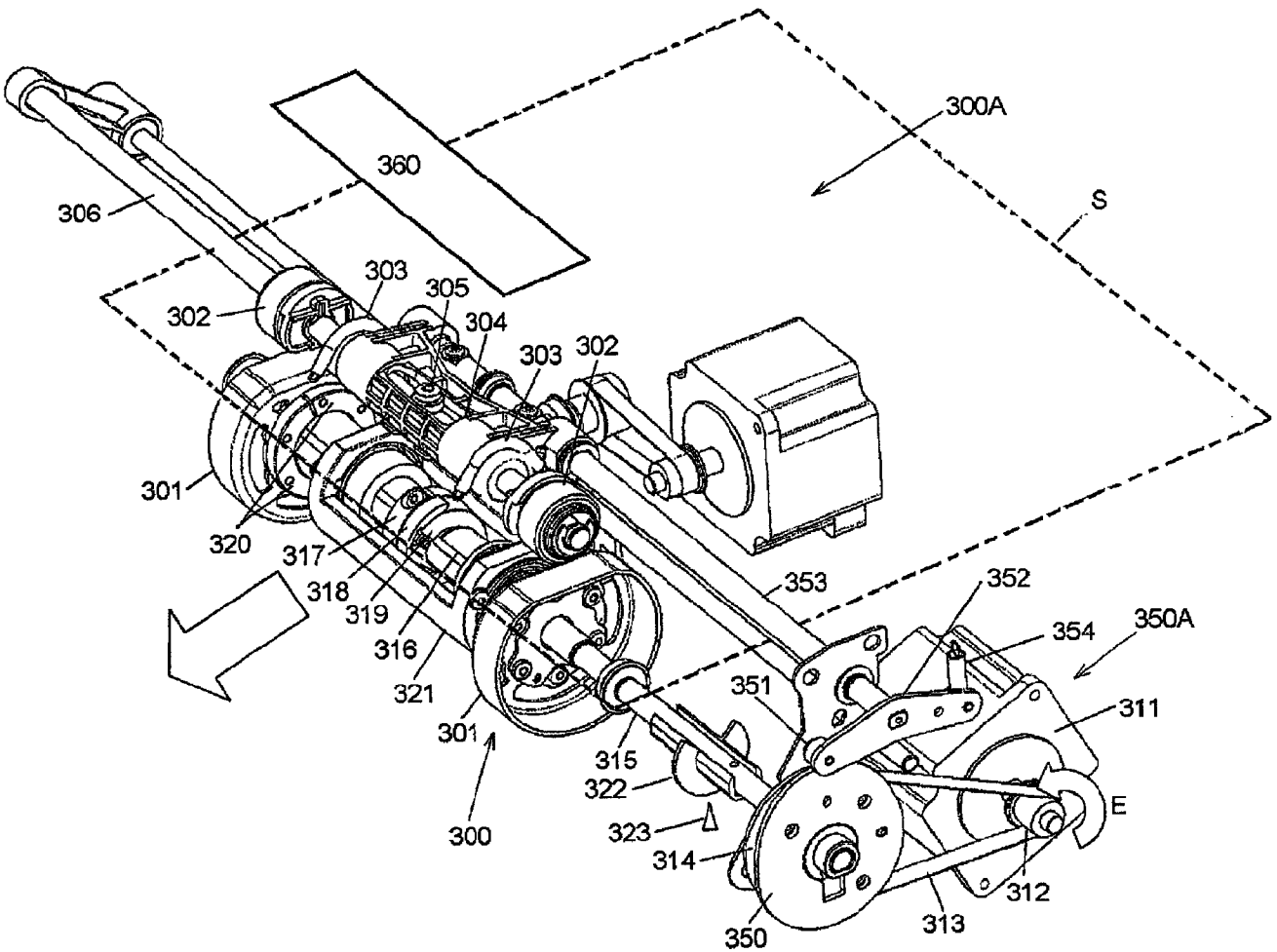
FIG. 7 is a first perspective view illustrating a configuration of a registration correction portion provided in the registration portion.

As illustrated in FIG. 7, the registration correction portion 300A includes the pair of registration rollers 300. The pair of registration rollers 300 includes a registration driving roller 301 and a registration driven roller 302. The registration driving roller 301 is a driving rotation body in which the notch is provided in the circumferential surface. The registration driven roller 302 is a driven rotation body that can be brought into contact with and separated from the registration driving roller 301. The registration driven roller 302 is attached to a registration driven roller shaft 306. The registration driven roller shaft 306 is slidably retained by a registration pressure holder 304 pressurized by a pressure spring 303 that is of a biasing member.

The registration driving roller 301 is coupled to a registration motor 311 through a motor pulley 312, a driving belt 313, a driving pulley 314, a registration driving shaft 315, a registration driving coma 317, a registration driving holder 316, and a registration fixed coma 320. The registration fixed coma 320 fixes the registration driving roller 301 to the registration driving holder 316. The registration driving holder 316 is provided so as to be slidable with respect to the registration driving shaft 315.

A registration HP sensor flag 322 is provided in the registration driving shaft 315 in order to detect the phase of the registration driving roller. A registration HP sensor 323 detects the position of the registration HP sensor flag 322, thereby detecting the phase (HP) of the registration driving roller 301.

The registration driving coma 317 is attached to the registration driving holder 316, and the registration driving coma 317 engages a groove 315*a* of the registration driving shaft 315 to transmit the drive. As illustrated in FIG. 8, a registration driving pressure coma 318 is rotatably coupled to the registration driving coma 317.

Figure 8A:
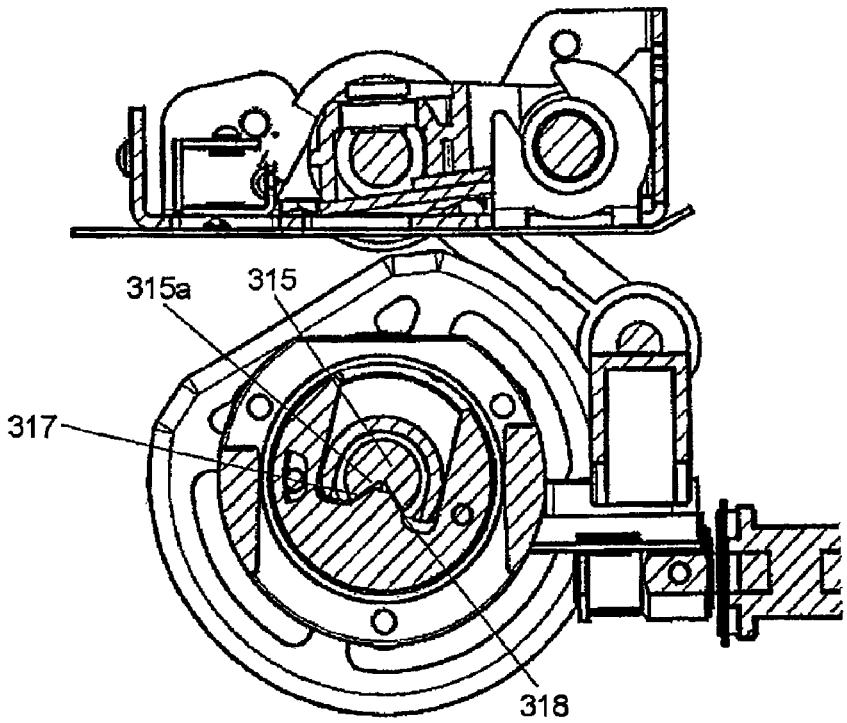
FIG. 8 is a first view illustrating the configuration of the registration correction portion.
Figure 8B:
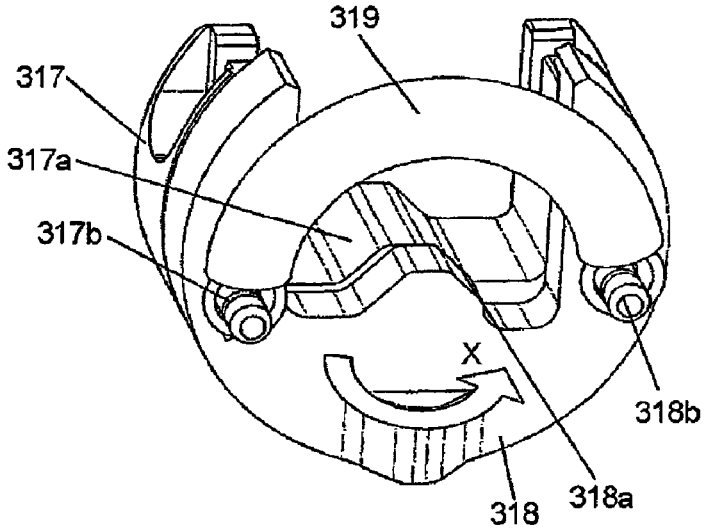
Figure 9A:
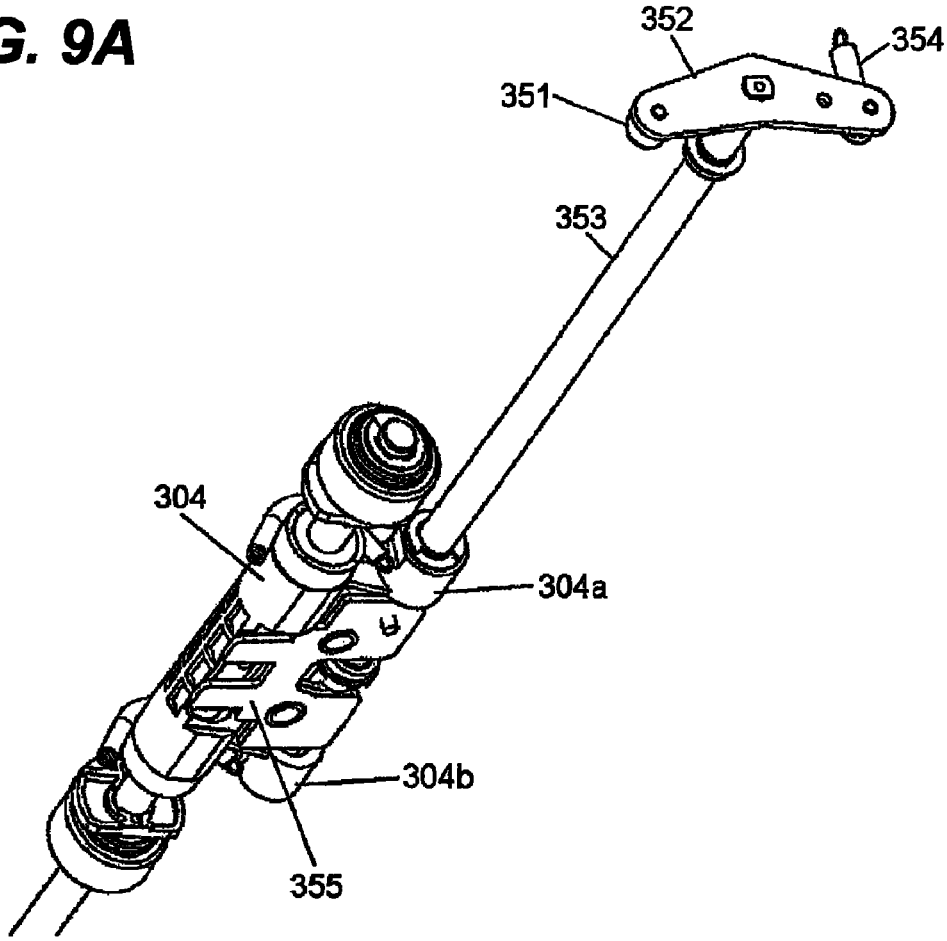
FIG. 9 is a second view illustrating the configuration of the registration correction portion.
Figure 9B:
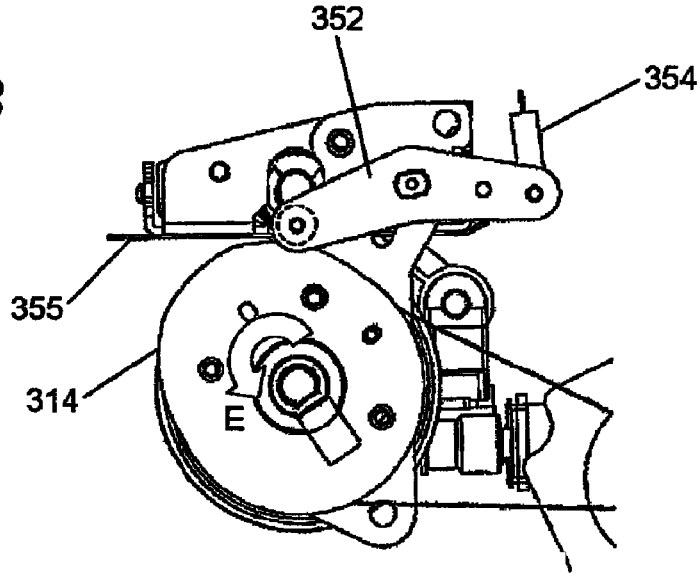

AS illustrated in FIG. 8B, the registration driving coma 317 and the registration driving pressure coma 318 are pressurized by the registration driving coma 317 and a pressure spring 319 so as to be rotated in an X-direction. The pressure spring 319 is hooked on spring hook portions 317*b* and 318*b* of the registration driving pressure coma 318. Therefore, contact surfaces 317*a* and 318*a* of the registration driving coma 317 and the registration driving pressure coma 318 with the V-groove 315*a* of the registration driving shaft 315 illustrated in FIG. 8A are pressurized in a direction in which the registration driving coma 317 and the registration driving pressure coma 318 are pushed into the V-groove 315*a* with rattle.

As illustrated in FIG. 7, a registration separation cam 350 is attached to the registration driving pulley 314. A link mechanism includes the registration separation cam 350 and the separation unit 350A. In synchronization with the rotation of the registration driving roller 301, the link mechanism can bring the registration driven roller 302 into contact with the registration driving roller 301 and separate the registration driven roller 302 from the registration driving roller 301. The separation unit 350A includes a striking roller 351, an arm 352, a registration link shaft 353, a pressure spring 354, and a registration separation arm 355.

Figure 10:
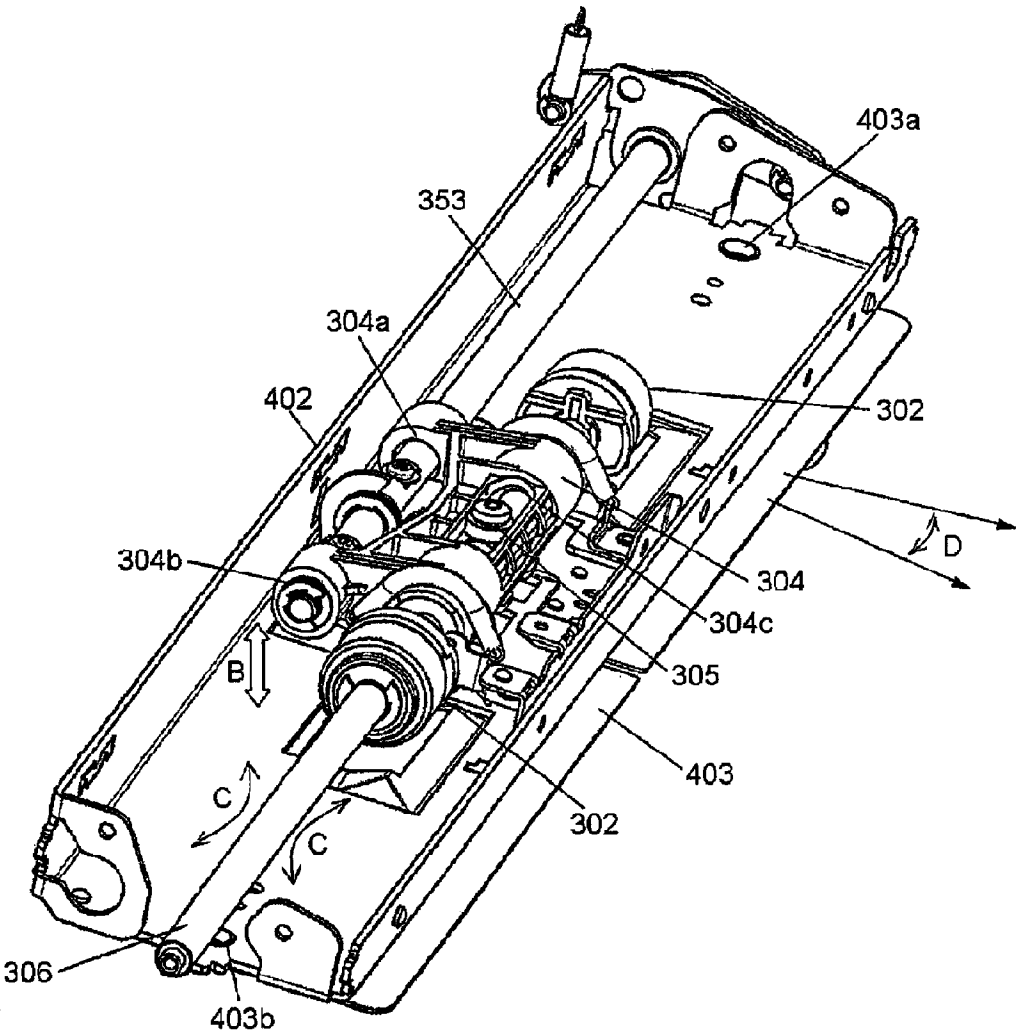
FIG. 10 is a second perspective view illustrating the configuration of the registration correction portion.

As illustrated in FIG. 10, the registration pressure holder 304 constitutes the holding portion that holds the registration driven roller 302, and the registration pressure holder 304 is rotatably held by the registration link shaft 353. The registration link shaft 353 is held by a registration frame 402, and the registration pressure holder 304 is turned about the registration link shaft 353. An end portion 304*a* of the registration pressure holder 304 is rotatably held by the registration link shaft 353, and an end portion 304*b* is held while being slidable in a vertical direction (direction of an arrow B) and rotatable (can be equalized). That is, the registration pressure holder 304 is rotatably loose-fitted in the registration link shaft 353 such that the registration driven roller 302 is evenly brought into pressure contact with the registration driving roller 301.

In the configuration of the embodiment, the pressurizing failure between the registration driving roller 301 and the registration driven roller 302 can be prevented even if the minute misalignment is generated between the registration driving roller shaft 315 and the registration link shaft 353. When the registration driving roller 301 is rotated, the registration driven roller 302 and the separation unit 350A are accurately linked, and the registration driven roller 302 can accurately be separated.

A slide groove 304C is provided in the registration pressure holder 304, and a roller 305 attached to the registration driven roller shaft 306 can be slid in the slide groove 304C. In cases where a minute warp (direction of an arrow C) exists in the registration driven roller shaft 306, sometimes the minute rotation is generated in the registration driven roller shaft 302 when the registration driven roller 302 is rotated. However, even if the minute rotation is generated in the registration driven roller shaft 306, the provision of the slide groove 304C prevents the conveying direction of the registration driven roller 302 from being deviated in a direction of an arrow D, so that generation of a conveyance variation can be prevented.

Figure 11:
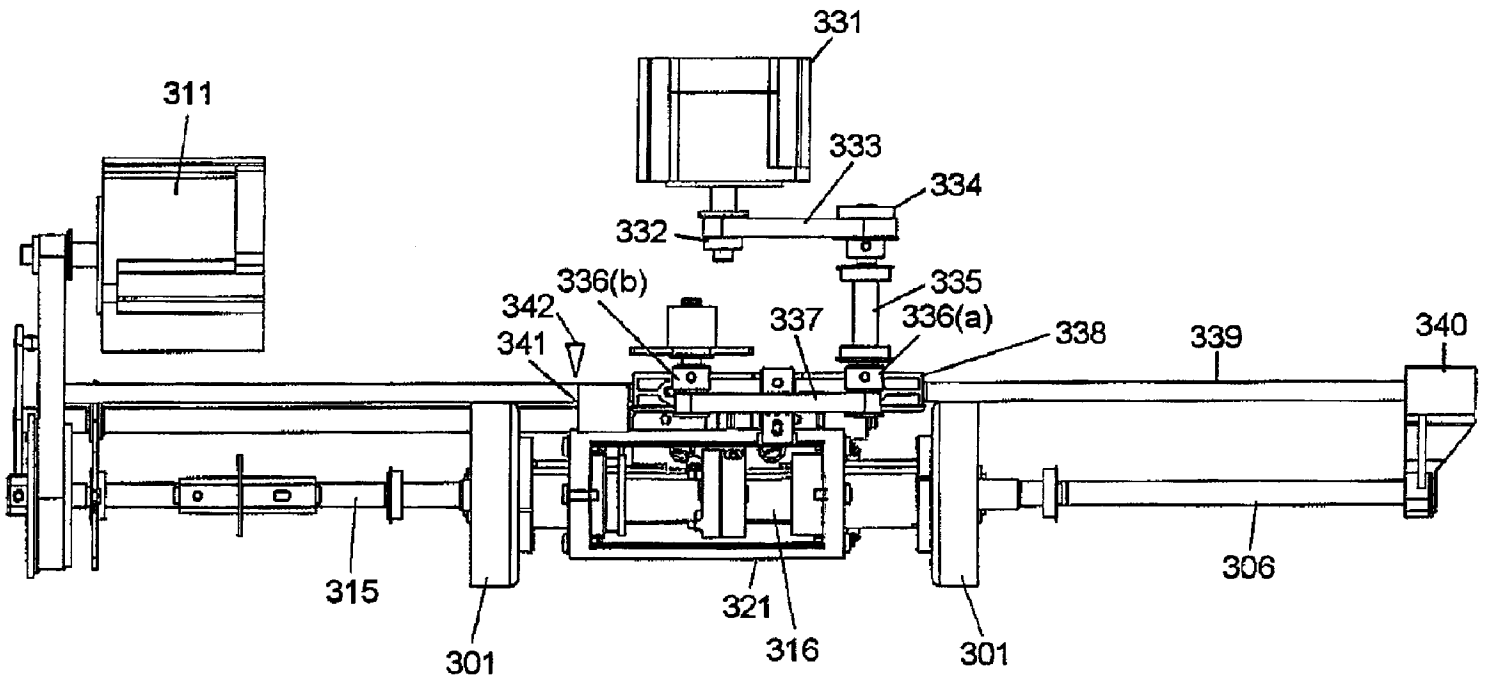
FIG. 11 is a plan view illustrating the configuration of the registration correction portion.

On the other hand, the pair of registration rollers 300 can be moved in the crosswise direction by a registration shift driving motor 331 of FIG. 11. The registration shift driving motor 331 is coupled to the registration driving roller 301 through a motor pulley 332, a driving belt 333, driving pulleys 334, 336*a*, and 336*b*, a pulley driving shaft 335, a shift driving transmission belt 337, and a registration coupling frame 321.

The registration coupling frame 321 rotatably holds the registration driving holder 316, and a registration shift HP sensor flag 341 is provided in the registration coupling frame 321 in order to detect the position of the registration driving roller 301. A registration shift HP sensor 342 detects the position of the registration shift HP sensor flag 341, thereby detecting the position of the registration driving roller 301.

The registration coupling frame 321 couples the shift drive to the registration driven roller shaft 306 through a shift driving coupling shaft 338, a shift driving shaft 339, and a driven roller driving coupling portion 340. Therefore, when the registration driving roller 301 is shifted in the crosswise direction, the registration driven roller 302 is also integrally shifted in the crosswise direction.

FIG. 7 illustrates the state in which the notch in the circumferential surface of the registration driving roller 301 faces the registration driven roller 302. At this point, the roller nip portion between the registration driving roller 301 and the registration driven roller 302 is released to release the sheet nip.

As illustrated in FIG. 7, a crosswise registration detection sensor 360 is provided in the crosswise direction and on the upstream side in the conveying direction of the pair of registration rollers 300 in order to detect the crosswise registration of the sheet S. When the sheet S in which the skew feeding is corrected by the pair of skew feeding correction rollers 210 and 220 on the upstream side reaches the pair of registration rollers 300, the sheet S is conveyed by the pair of registration rollers 300, and the sheet S is passed through the crosswise registration 0.

When the crosswise registration detection sensor 360 detects the crosswise registration of the sheet, the registration motor 311 is started up in a direction of an arrow E of FIG. 7 according to a crosswise registration amount detected by the crosswise registration detection sensor 360. As a result, the registration driving roller 301 is rotated, the registration driven roller 302 is synchronized with the registration driving roller 301 through the separation unit 350A, the registration driven roller 302 is moved in a downward direction in which the registration driven roller 302 is brought into pressure contact with the registration driving roller 301, and the registration driven roller 302 is brought into pressure contact with the registration driving roller 301. The registration driven roller 302 is brought into pressure contact with the registration driving roller 301, the sheet S is delivered from the upstream side after a predetermined time, and the pair of registration rollers 300 conveys the sheet S to the image forming portion 1003.

Figure 12:
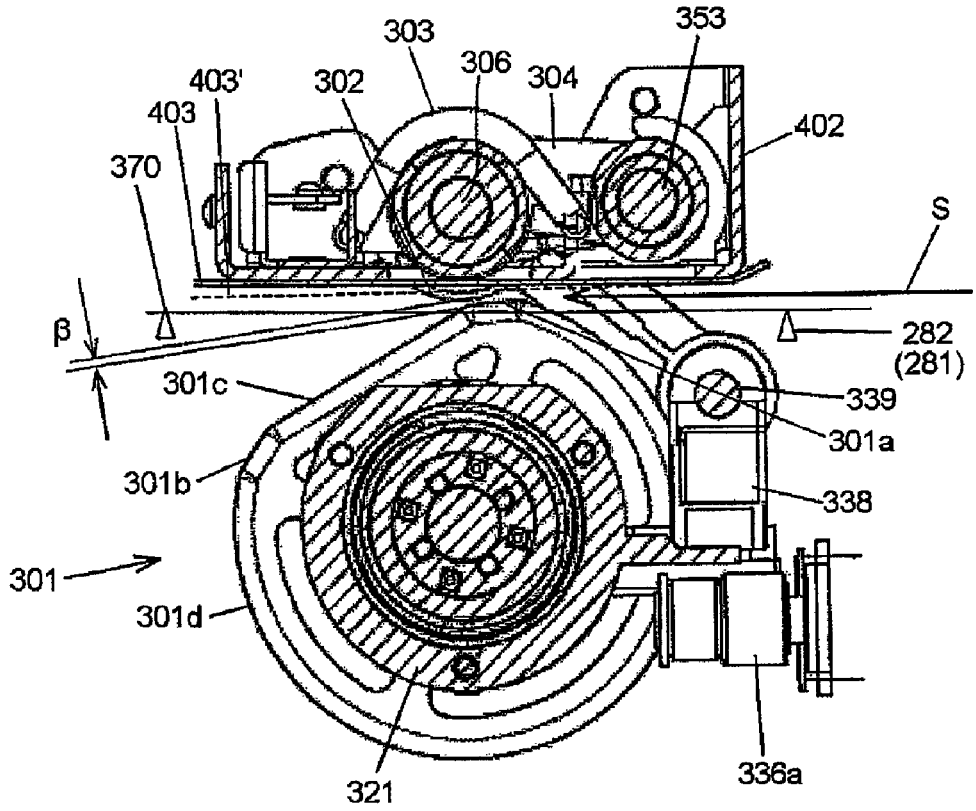
FIG. 12 is a side view illustrating the configuration of the registration correction portion.

FIG. 12 illustrates the state in which the registration driven roller 302 is lowered to cause the registration pressure holder 304 to strike on a registration upper guide 403 attached to the registration frame 402. The registration pressure holder 304 strikes on the registration upper guide 403 immediately before the registration driven roller 302 is brought into pressure contact with the registration driving roller 301.

Therefore, when the registration pressure holder 304 strikes on the registration upper guide 403, a minute gap β is formed between the registration driven roller 302 and a slope portion 301*a* of the registration driving roller 301. The slope portion 301*a* constitutes a taper portion that couples a non-feeding portion 301*c* and a feeding portion 301*d*. The non-feeding portion 301*c* is the notch provided in the circumferential surface of the registration driving roller 301 so as not to contact the sheet S. The arc-shape feeding portion 301*d* contacts the sheet S.

That is, in the embodiment, in downwardly moving the registration driven roller 302, the registration driven roller 302 is not directly brought into pressure contact with (collides on) the registration driving roller 301, but the registration driven roller 302 collides on the registration upper guide 403 while the registration pressure holder 304 is interposed therebetween before the registration driven roller 302 is brought into pressure contact with the registration driving roller 301, and the registration driven roller 302 is stopped at the pressure contact position. Then, the slope portion 301*a* of the registration driving roller 301 which is rotated is brought into contact with the registration driven roller 302 that is stopped at the pressure contact position, thereby forming the roller nip portion.

When the registration driving roller 301 is brought into contact with the registration driven roller 302 that is in the stopped state, the vibration is generated in the registration driven roller 302. However, as with the case of FIG. 6, before the registration driven roller 302 collides with the registration driving roller 301, the registration pressure holder 304 and the skew feeding correction frame 401 collides with each other to generate the vibration.

When the attenuation of the vibration is started, the registration driving roller 301 and the registration driven roller 302 are brought into pressure contact with each other, thereby generating the second vibration. When the attenuation of the second vibration is substantially ended, the sheet S is nipped between and conveyed by the pair of registration driving rollers 300.

Because the pair of registration rollers 300 has the pressure contact force larger than that of the pair of skew feeding correction rollers 220 and 210, the skew feeding correction frame 401 absorbs the shock when the pressure holder 225 collides with the skew feeding correction frame 401. Therefore, in the embodiment, the registration upper guide 403 is tightened at two points 403*a* and 403*b* as illustrated in FIG. 10. The registration upper guide 403 is a guide member that guides a sheet attached to the bottom surface of the registration frame 402. The registration frame 402 is a support frame. Therefore, the registration upper guide 403 can bend in the vertical direction with respect to the registration frame 402.

The registration pressure holder 304 is made of a resin material such as ABS and POM which has an elastic modulus lower than that of metal used for the registration frame 402 or registration upper guide 403, whereby the registration pressure holder 304 absorbs the shock in the moment the registration pressure holder 304 strikes on the skew feeding correction frame 401. Therefore, when the pressure holder 225 collides with the skew feeding correction frame 401, the registration upper guide 403 bends as illustrated by a broken line 403' of FIG. 12, and the registration pressure holder 304 absorbs the shock in the collision with the skew feeding correction frame 401.

Because the sheet S is conveyed in the state in which the vibration of the registration driven roller 302 is sufficiently attenuated rather than ΔL1 of FIG. 6, the generation of the skew feeding caused by a difference in pressure balance in front of and behind the registration driven roller 302 can be prevented. Therefore, the crosswise registration correction and the lengthwise registration correction can accurately be performed.

Figure 13:
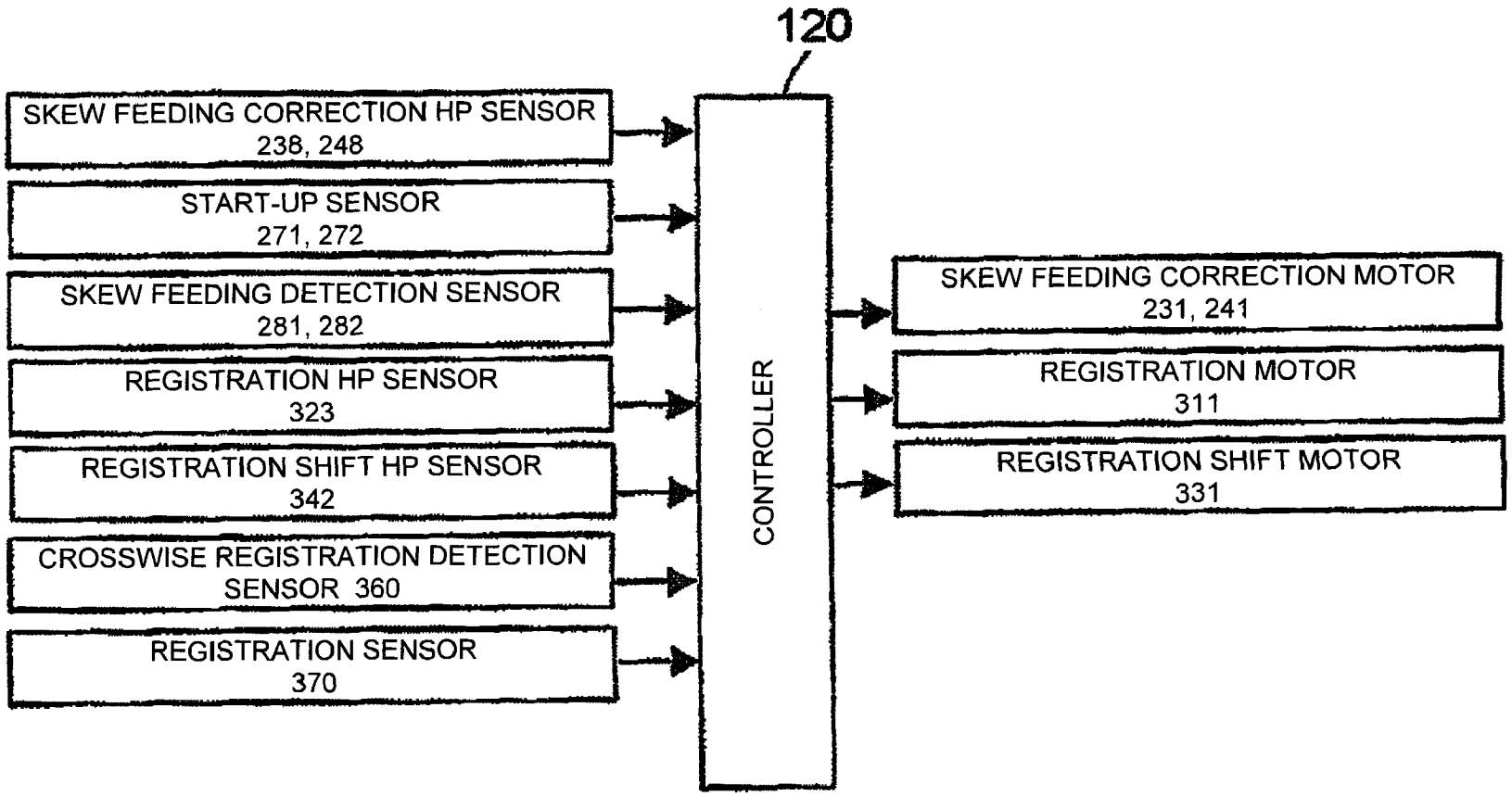
FIG. 13 illustrates a control block diagram of the printer.

FIG. 13 illustrates a control block of the printer 1000. The detection signals are fed into the controller 120 (see FIG. 1) from the skew feeding correction HP sensors 238 and 248, and the start-up sensor 271 and 272. The controller 120 controls the drive of the skew feeding correction motor 231 and 241 and registration motor 311 based on the detection signals fed from the skew feeding correction HP sensors 238 and 248 and start-up sensor 271 and 272.

Figure 14:
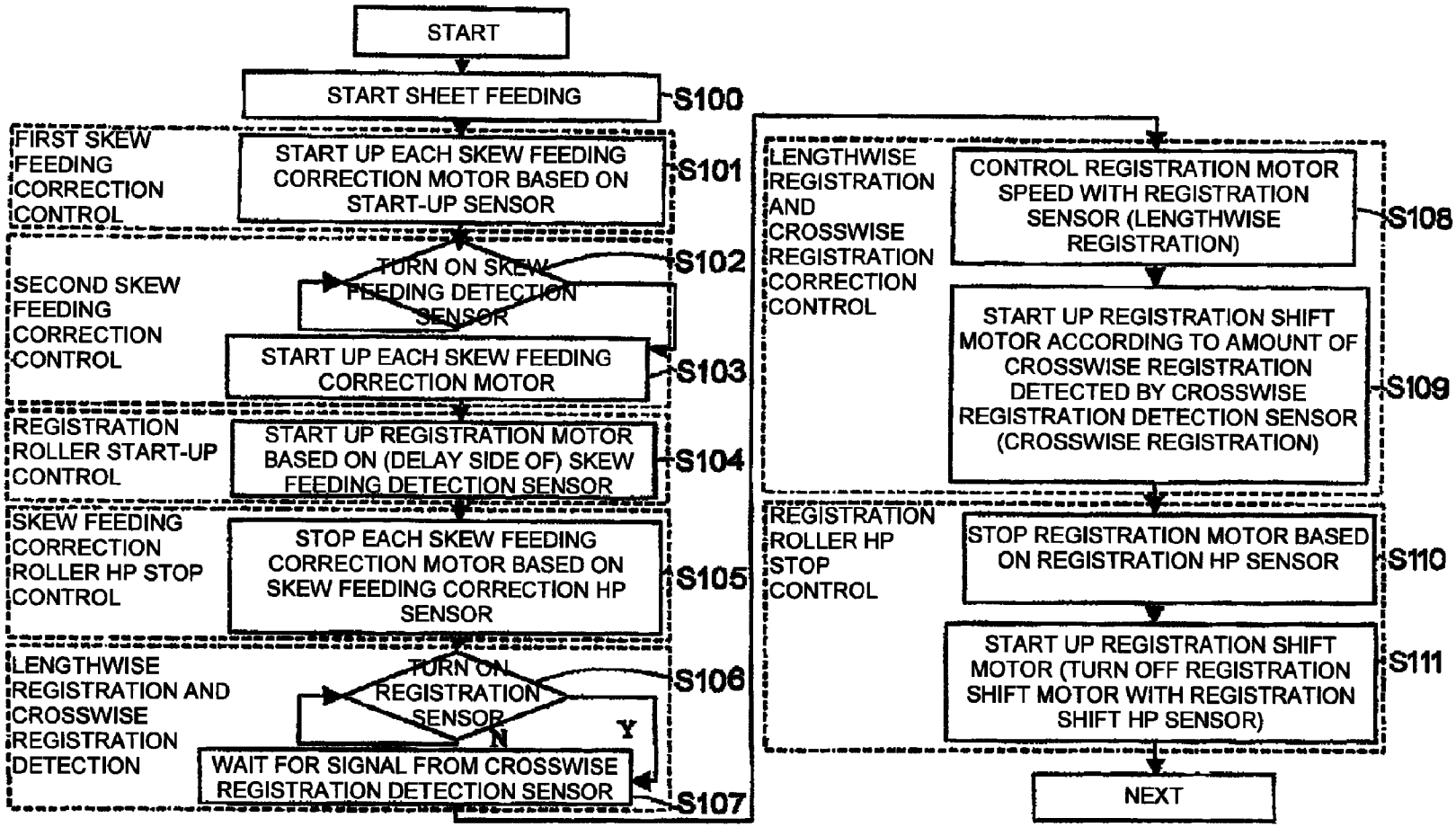
FIG. 14 is a flowchart illustrating skew feeding correction and a registration correction control operation with the registration portion.

As illustrated in FIG. 14, the controller 120 performs the skew feeding correction and the registration correction control operation.

When the sheet feeding is started (S100), the controller 120 starts up (drives) the two skew feeding correction motors based on the start-up sensor (S101), thereby correcting the skew feeding (first skew feeding correction control). When the skew feeding detection sensor detects the skew feeding again to be turned on (Y in S102), the controller 120 starts up the skew feeding correction motors (S103), thereby correcting the skew feeding (second skew feeding correction control).

Then the controller 120 starts up the registration motors based on the (delay side of) skew feeding detection sensor (S104: registration roller start-up control). The controller 120 stops the skew feeding correction motors based on the skew feeding correction HP sensor (S105: skew feeding correction roller HP stop control).

When the registration sensor detects the sheet to be turned on (Y in S106), the controller 120 waits for the signal from the crosswise registration detection sensor (S107) (lengthwise registration and crosswise registration detection). The controller 120 controls the speed of the registration motor with the signal from the registration sensor (S108). Then the controller 120 starts up the registration shift motor according to the crosswise registration amount detected by the crosswise registration detection sensor (S109) (lengthwise registration and crosswise registration correction control). Therefore, the leading end position and crosswise position of the image position can be matched with those of the sheet S in the transfer portion.

When the pair of registration rollers conveys the sheet to the transfer portion, the controller 120 stops the registration motor based on the registration HP sensor while the roller nip of the pair of registration rollers is released (S110). At the same time, the controller 120 starts up the registration shift motor to move the pair of registration rollers in the opposite direction to the correction direction. When the registration shift HP sensor is turned off, the registration shift motor is stopped (S111) (registration roller HP stop control).

As described above, in the embodiment, before the driving roller 221 is brought into pressure contact with the driven roller 222, the striking portion 225*a* of the pressure holder 225 strikes on the skew feeding correction frame 401 to disperse the shock, which shortens the attenuation time of the vibration. Further, before the registration driving roller 301 is brought into pressure contact with the registration driven roller 302, the registration pressure holder 304 strikes on the registration upper guide 403 attached to the registration frame 402 to disperse the shock, which shortens the attenuation time of the vibration. Therefore, the generation of the sheet skew feeding caused by the shock can be reduced when the driving roller 221 is brought into pressure contact with the driven roller 222, or when the registration driving roller 301 is brought into pressure contact with the registration driven roller 302.

The configuration of the embodiment can be simplified because the adjustment of the separation amount or attachment/detachment timing of the pair of rollers is not required. Therefore, a labor hour can largely be decreased in the factory and the field. Further, because the shock can be absorbed even if the attachment/detachment timing is changed by the roller abrasion, a lifetime of the roller can be improved.

In the embodiment, in cases where the pair of skew feeding correction rollers 220 and 210 has the small pressure, before the nip is formed between the pair of skew feeding correction rollers 220 and 210, the pressure holder 225 strikes on the skew feeding correction frame 401 to shorten the attenuation time of the vibration. In cases where the pair of registration rollers 300 has the large pressure, before the nip is formed between the pair of registration rollers 300, the low-elastic-modulus registration upper guide 403 attached to the registration frame 402 collides with the registration pressure holder 304.

However, the invention is not limited to the embodiment. For example, the driven rollers 212 and 222 or the driven roller shafts 216 and 226 may strike directly on the skew feeding correction frame 401. The registration driven roller 302 or the registration driven roller shaft 306 may directly strike on the registration upper guide 403 or the registration frame 402.

Figure 15:
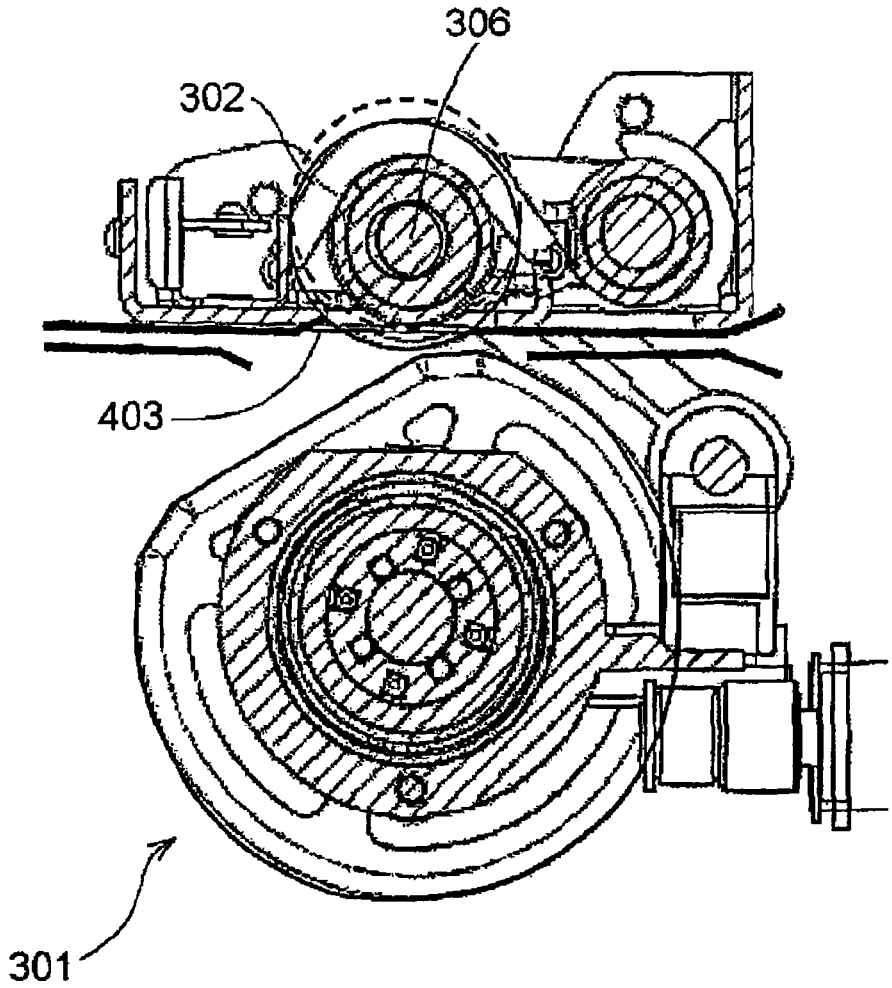
FIG. 15 is a first view illustrating another configuration of the registration correction portion.

FIG. 15 illustrates a configuration in which the registration driven roller 302 abuts directly on the registration upper guide 403 provided in the skew feeding correction frame 401. As illustrated in FIG. 15, even if the registration driven roller 302 strikes directly on (the registration upper guide 403 of) the skew feeding correction frame 401, the generation of the sheet skew feeding caused by the shock can be reduced when the registration driving roller 301 is brought into pressure contact with the registration driven roller 302.

Figure 16:
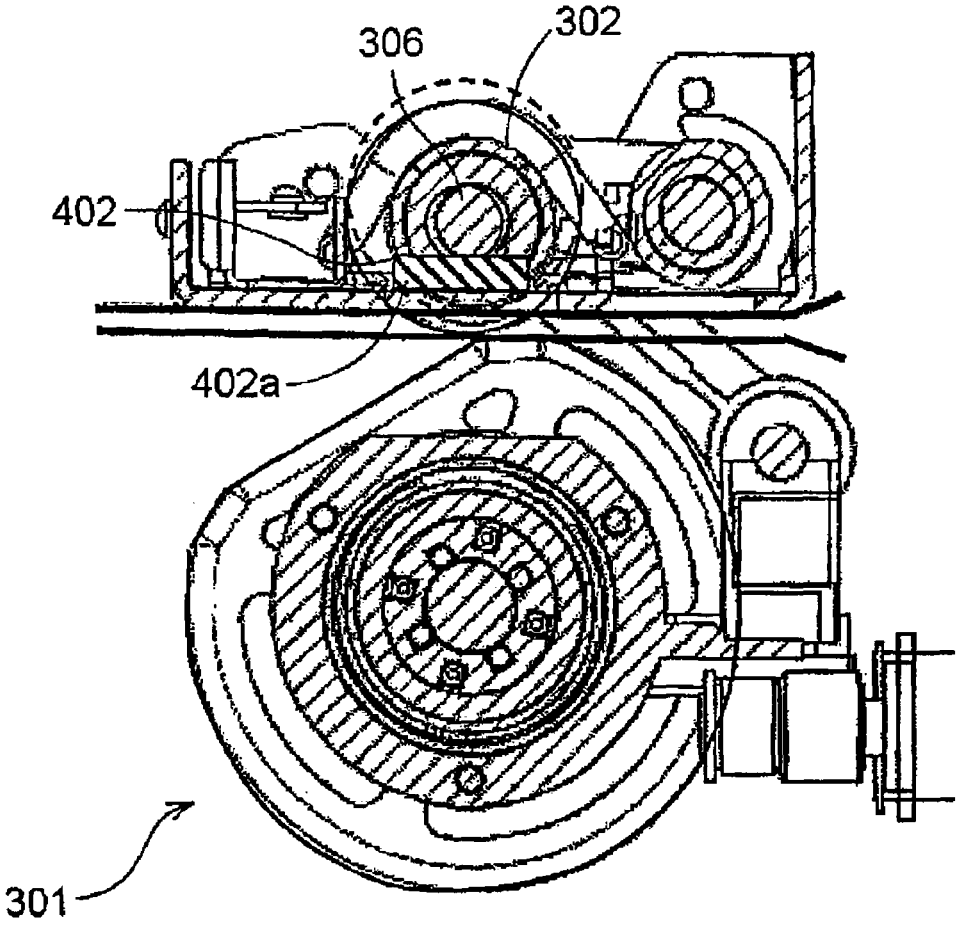
FIG. 16 is a second view illustrating another configuration of the registration correction portion.
Figure 17:
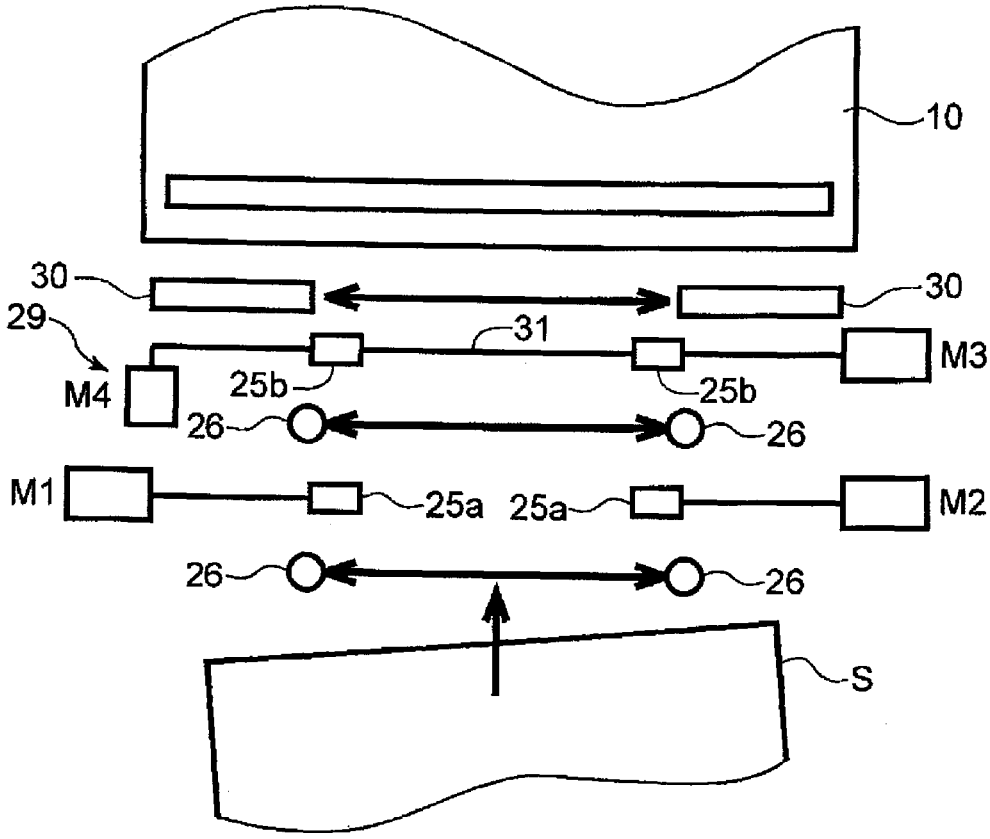
FIG. 17 PRIOR ART
FIG. 17 illustrates a configuration of a conventional skew feeding correction portion.
Figure 18A:
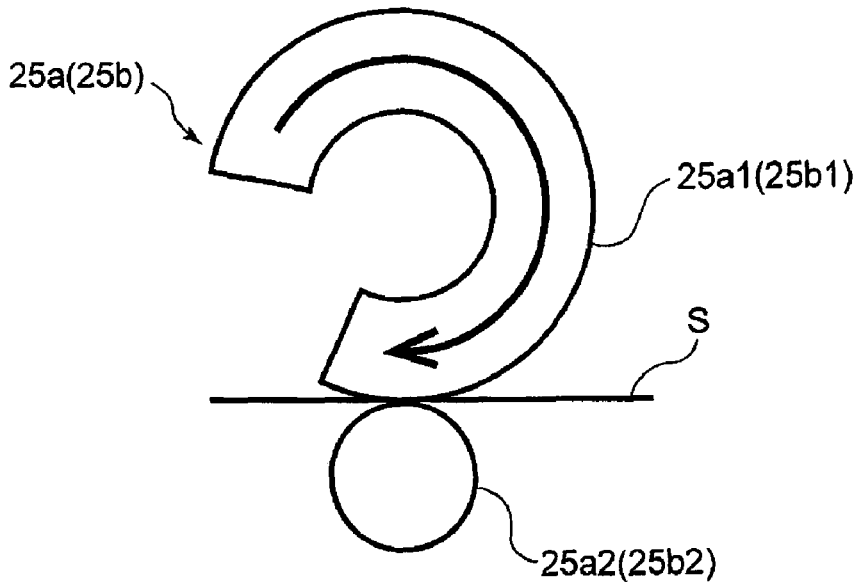
FIG. 18A PRIOR ART
FIG. 18 illustrates a configuration of a pair of skew feeding correction rollers and a pair of registration rollers of the conventional skew feeding correction portion.
Figure 18B:
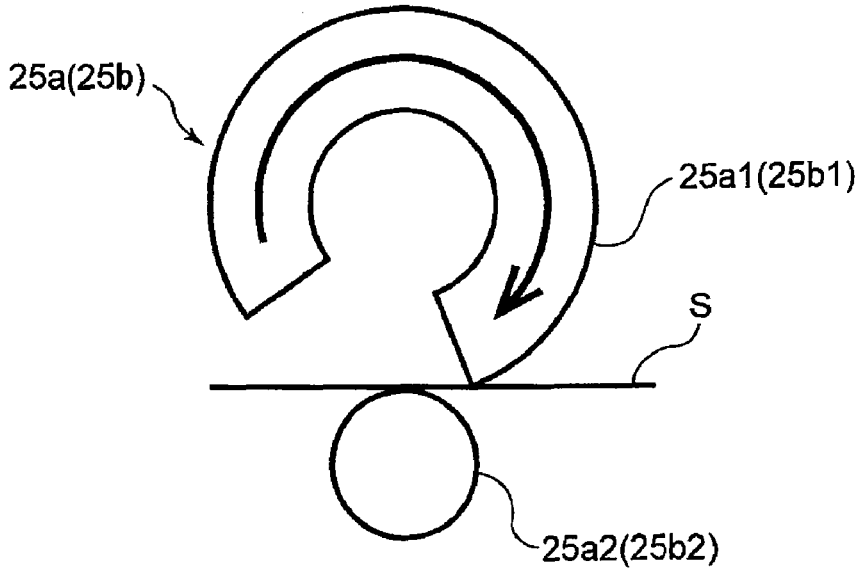
FIG. 18B PRIOR ART
Figure 19:
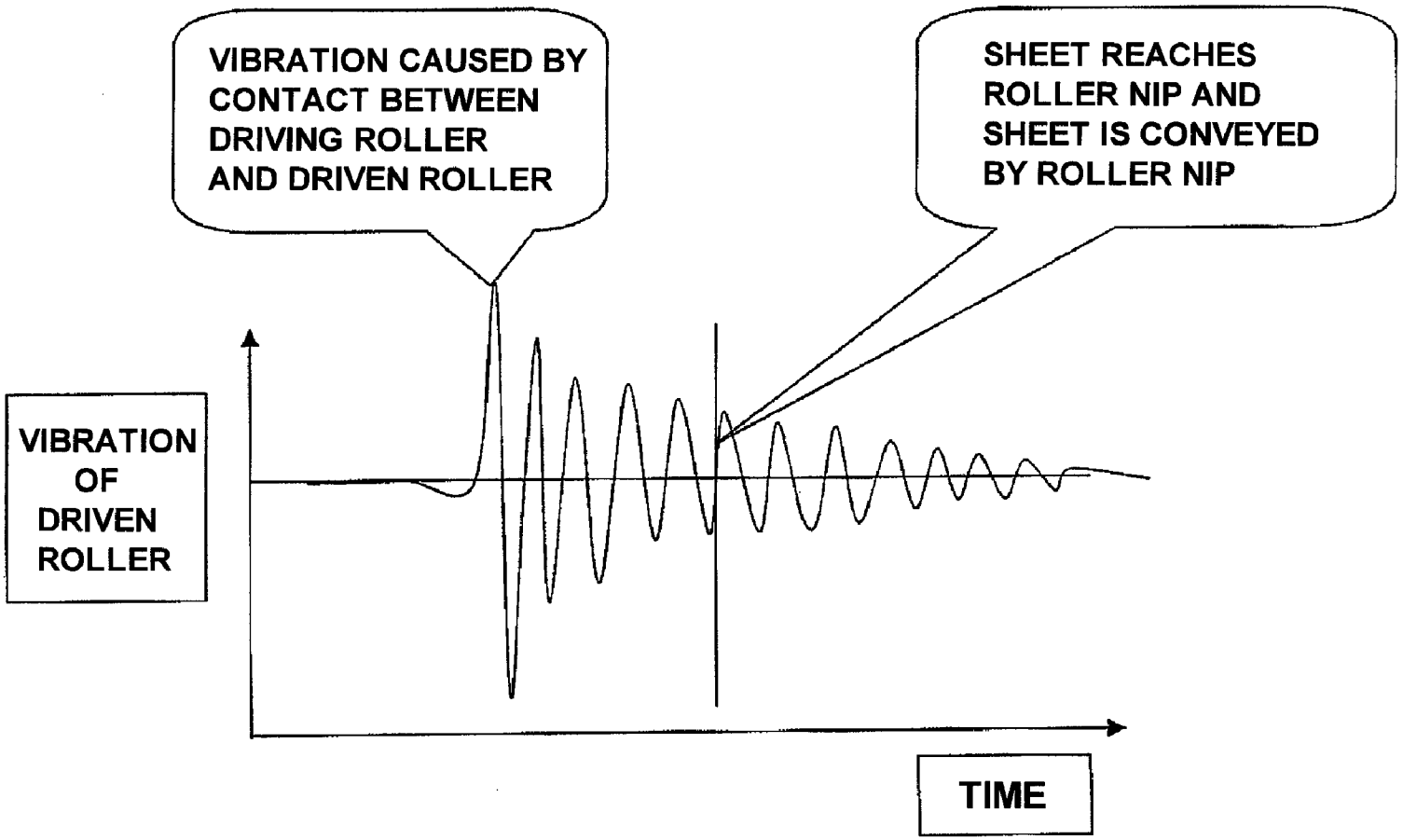
FIG. 19 PRIOR ART
FIG. 19 illustrates a vibration of a driven roller constituting the pair of skew feeding correction rollers.
Figure 20A:
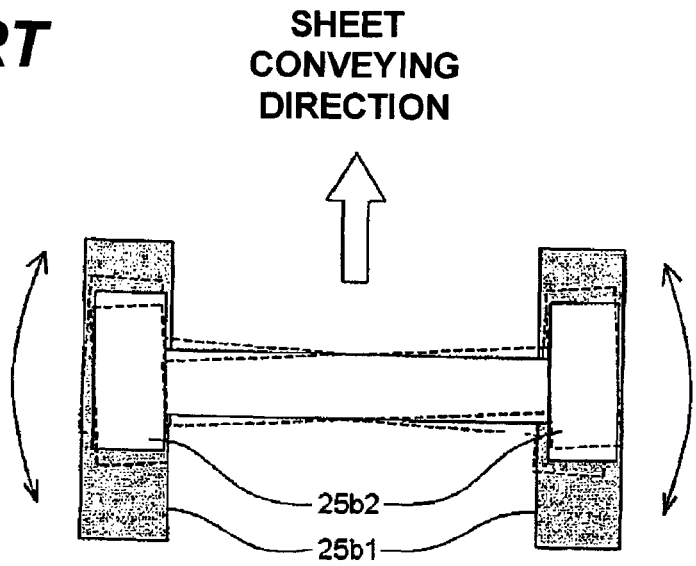
FIG. 20A PRIOR ART
FIG. 20 illustrates a vibration direction of the driven roller constituting the pair of skew feeding correction rollers.
Figure 20B:
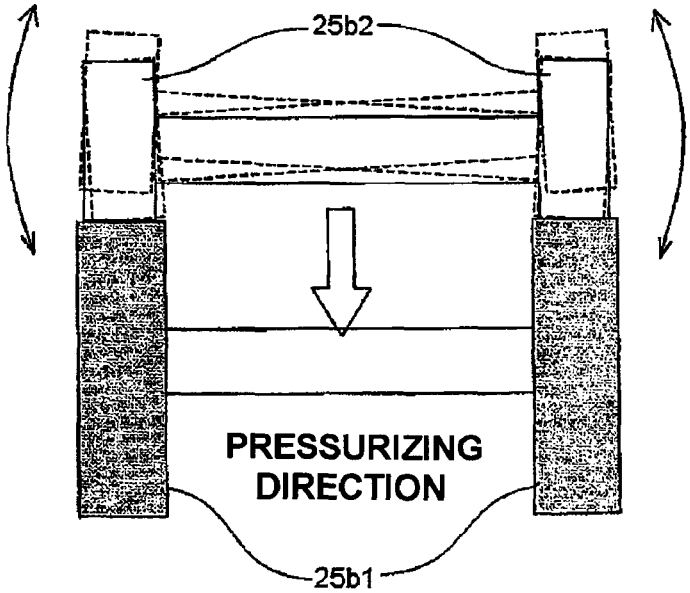
FIG. 20B PRIOR ART

FIG. 16 illustrates a configuration in which the registration driven roller shaft 306 is directly struck on a striking portion 402*a* perpendicularly provided in the skew feeding correction frame 401. As illustrated in FIG. 16, even if the registration driven roller shaft 306 strikes directly on (the striking portion 402*a* of) the skew feeding correction frame 401, the generation of the sheet skew feeding caused by the shock can be reduced when the registration driving roller 301 is brought into pressure contact with the registration driven roller 302.

In the embodiment, the sheet conveying apparatus of the invention is applied to the printer that is of an example of the image forming apparatus. However, the invention is not limited to the printer. For example, the invention can also be applied to the image reading apparatus constituting the image reading portion 2001 of FIG. 1 such that the sheet S can correctly be aligned with no inclination in the image reading portion.

While the present invention has been described with reference to exemplary embodiments, it is to be understood that the invention is not limited to the disclosed exemplary embodiments. The scope of the following claims is to be accorded the broadcast interpretation so as to encompass all such modifications and equivalent structures and functions.

This application claims the benefit of Japanese Patent Application No. 2008-139983, filed May 28, 2008, which is hereby incorporated by reference herein in its entirety.

What is claimed is:

1. A sheet conveying apparatus that conveys a sheet, the sheet conveying apparatus comprising:

a driving rotation body that has a notch in a circumferential surface thereof;

a driven rotation body that is pressure-contactable with the circumferential surface of the driving rotation body;

a holding portion rotatably supported that holds the driven rotation body;

a biasing member that biases the holding portion toward a pressure contact position at which the driven rotation body is brought into pressure contact with the driving rotation body;

a separating mechanism that moves the driven rotation body to a separation position, at which the driven rotation body is separated from the driving rotation body against a biasing force of the biasing member while the sheet is being conveyed; and an abutment portion that is abuttable by the holding portion to stop the driven rotation body, which is moved from the separation position by the biasing force by the biasing member, at the pressure contact position, wherein after the holding portion abuts the abutment portion to stop the driven rotation body at the pressure contact position, the circumferential surface of the driving rotation body is brought into pressure contact with the driven rotation body to convey the sheet.

2. The sheet conveying apparatus according to claim 1, wherein:

the driving rotation body includes a taper portion that couples the notch and the circumferential surface except for the notch, and the circumferential surface except for the notch of the driving rotation body is brought into pressure contact with the driven rotation body after the taper portion is brought into pressure contact with the driven rotation body that is stopped while abutting the abutment portion.

3. The sheet conveying apparatus according to claim 2, wherein the abutment portion is one of a support frame that rotatably supports the holding portion or a guide member that guides a sheet.

4. The sheet conveying apparatus according to claim 3, wherein the holding portion is made of a material having an elastic modulus of the abutment portion.

5. The sheet conveying apparatus according to claim 1, wherein the separating mechanism includes:

a cam portion that is attached to a rotation shaft of the driving rotation body; and a turning link portion that is brought into pressure contact with the cam portion to turn the holding portion.

6. The sheet conveying apparatus according to claim 5, wherein the holding portion is rotatably loose-fitted in a turning center of the turning link portion such that the driven rotation body is evenly brought into pressure contact with the driving rotation body.

7. The sheet conveying apparatus according to claim 1, wherein the driving rotation body and the driven rotation body constitute a sheet skew feeding correction mechanism that corrects sheet skew feeding.

8. The sheet conveying apparatus according to claim 1, wherein the driving rotation body and the driven rotation body constitute a crosswise displacement correction mechanism that corrects a sheet displacement in a crosswise direction orthogonal to a sheet conveying direction.

9. An image forming apparatus comprising:

a sheet conveying apparatus that conveys a sheet; and an image forming portion that forms an image on the sheet conveyed by the sheet conveying apparatus, wherein the sheet conveying apparatus includes:

a driving rotation body that has a notch in a circumferential surface thereof;

a driven rotation body that is pressure-contactable with the circumferential surface of the driving rotation body;

a holding portion rotatably supported that holds the driven rotation body;

a biasing member that biases the holding portion toward a pressure contact position at which the driven rotation body is brought into pressure contact with the driving rotation body;

a separating mechanism that moves the driven rotation body to a separation position, at which the driven rotation body is separated from the driving rotation body against a biasing force of the biasing member, while the sheet is being conveyed; and an abutment portion that is abuttable by the holding portion to stop the driven rotation body, which is moved from the separation position by the biasing force by the biasing member, at the pressure contact position, wherein after the holding portion abuts the abutment portion to stop the driven rotation body at the pressure contact position, the circumferential surface of the driving rotation body is brought into pressure contact with the driven rotation body.

10. The image forming apparatus according to claim 9, wherein:

the driving rotation body includes a taper portion that couples the notch and the circumferential surface except for the notch, and the circumferential surface except for the notch of the driving rotation body is brought into pressure contact with the driven rotation body after the taper portion is brought into pressure contact with the driven rotation body that is stopped while abutting the abutment portion.

11. The image forming apparatus according to claim 10, wherein the abutment portion is one of a support frame that rotatably supports the holding portion or a guide member that guides a sheet.

12. The image forming apparatus according to claim 11, wherein the holding portion is made of a material having an elastic modulus of the abutment portion.

13. The image forming apparatus according to claim 9, wherein the separating mechanism includes:

a cam portion that is attached to a rotation shaft of the driving rotation body; and a turning link portion that is brought into pressure contact with the cam portion to turn the holding portion.

14. The image forming apparatus according to claim 13, wherein the holding portion is rotatably loose-fitted in a turning center of the turning link portion such that the driven rotation body is evenly brought into pressure contact with the driving rotation body.

15. The image forming apparatus according to claim 9, wherein the driving rotation body and the driven rotation body constitute a sheet skew feeding correction mechanism that corrects sheet skew feeding.

16. The image forming apparatus according to claim 9, wherein the driving rotation body and the driven rotation body constitute a crosswise displacement correction mechanism that corrects a sheet displacement in a crosswise direction orthogonal to a sheet conveying direction.

17. An image reading apparatus comprising:

a sheet conveying apparatus that conveys a sheet; and an image reading portion that reads an image on the sheet conveyed by the sheet conveying apparatus, wherein the sheet conveying apparatus includes:

a driving rotation body that has a notch in a circumferential surface thereof;

a driven rotation body that is pressure-contactable with the circumferential surface of the driving rotation body;

a holding portion rotatably supported that holds the driven rotation body;

a biasing member that biases the holding portion toward a pressure contact position at which the driven rotation body is brought into pressure contact with the driving rotation body;

a separating mechanism that moves the driven rotation body to a separation position, at which the driven rotation body is separated from the driving rotation body against a biasing force of the biasing member, while the sheet is being conveyed; and an abutment portion that is abuttable by the holding portion to stop the driven rotation body, which is moved from the separation position by the biasing force by the biasing member, at the pressure contact position, wherein after the holding portion abuts the abutment portion to stop the driven rotation body at the pressure contact position, the circumferential surface of the driving rotation body is brought into pressure contact with the driven rotation body to convey the sheet.

* * * * *